US010073411B2

(12) United States Patent
Komatsu et al.

(10) Patent No.: US 10,073,411 B2
(45) Date of Patent: Sep. 11, 2018

(54) IMAGE FORMING APPARATUS

(71) Applicant: CANON KABUSHIKI KAISHA, Tokyo (JP)

(72) Inventors: Noriyuki Komatsu, Numazu-shi (JP); Tetsuya Numata, Suntou-gun (JP); Osamu Anan, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/451,909

(22) Filed: Mar. 7, 2017

(65) Prior Publication Data

US 2017/0261925 A1 Sep. 14, 2017

(30) Foreign Application Priority Data

Mar. 9, 2016 (JP) ..... 2016-045693

(51) Int. Cl.
*G03G 21/18* (2006.01)

(52) U.S. Cl.
CPC ..... *G03G 21/1842* (2013.01)

(58) Field of Classification Search
CPC ..... G03G 21/185
See application file for complete search history.

(56) References Cited

U.S. PATENT DOCUMENTS

| | | | | |
|---|---|---|---|---|
| 8,010,014 | B2 | 8/2011 | Noguchi | |
| 8,131,181 | B2 | 3/2012 | Hoashi | |
| 8,358,954 | B2 | 1/2013 | Tanaka | |
| 8,639,162 | B2 | 1/2014 | Tateishi | |
| 8,682,212 | B2 | 3/2014 | Kikuchi et al. | |
| 2004/0258432 | A1* | 12/2004 | Hatori | G03G 21/1839 399/111 |
| 2013/0170855 | A1* | 7/2013 | Mori | G03G 15/0189 399/110 |

FOREIGN PATENT DOCUMENTS

| | | | |
|---|---|---|---|
| JP | 2003005611 | A | 1/2003 |
| JP | 2009258279 | A | 11/2009 |
| JP | 2010102175 | A | 5/2010 |
| JP | 2010102321 | A | 5/2010 |
| JP | 2010122661 | A | 6/2010 |
| JP | 2010197869 | A | 9/2010 |
| JP | 2010250287 | A | 11/2010 |
| JP | 2012014154 | A | 1/2012 |

* cited by examiner

*Primary Examiner* — Clayton E Laballe
*Assistant Examiner* — Jas Sanghera
(74) *Attorney, Agent, or Firm* — Rossi, Kimms & McDowell LLP

(57) ABSTRACT

An image forming apparatus includes a cartridge including a rotatable photosensitive drum or a rotatable developing sleeve; and a supporting member for detachably supporting the cartridge, the supporting member and being movable between an inside position for permitting mounting of the cartridge to the apparatus and an outside position in direction along an axial direction of the drum or the sleeve. The cartridge is mountable to the supporting member from above. When the supporting member is in the outside position with the cartridge mounted thereon, an upstream end of the supporting member with respect to a moving direction from the inside position toward the outside position is inside the forming apparatus. When the supporting member is in the outside position, a downstream portion thereof is lower than that when the supporting member is in the inside position.

9 Claims, 20 Drawing Sheets

IMAGE FORMING APPARATUS

FIELD OF THE INVENTION AND RELATED ART

The present invention relates to an image forming apparatus such as a laser beam printer and a facsimileing machine which uses an electrophotographic image formation process.

In the field of an image forming apparatus which uses an electrophotographic image formation process, there have been known image forming systems which use a process cartridge, which is an integral combination of a photosensitive drum, as an image bearing member, and a development unit which develops an electrostatic image on the photosensitive drum. There have also been known image formation systems which use a development cartridge, that is, a cartridge which is made up of only a development unit, and image formation systems which use a photosensitive member cartridge, that is, a cartridge in which a photosensitive drum, and components for processing the photosensitive drum, are integrally disposed. Cartridge-based image formation systems make it possible for a user to maintain image forming apparatuses by him- or herself. Thus, cartridge-based image formation systems are widely in use.

Further, there have been known image forming apparatuses structured so that cartridges such as those described above are inserted into, or removed from a drawer (cartridge supporting member) which can be moved into, or virtually out of, the image forming apparatus. This structural arrangement for an image forming apparatus makes it possible for a user to move the drawer from its innermost position in the main assembly of an image forming apparatus, to its outermost position, to replace the cartridges. Thus, it makes it easier for a user to replace the cartridges.

In the case of an image forming apparatus structured so that its cartridge drawer can be moved out of the main assembly of the apparatus, as the drawer is moved outward of the main assembly, the center of gravity of the main assembly of the apparatus shifts, making the main assembly unstable.

Thus, there have been proposed various structural arrangements for keeping stable an image forming apparatus equipped with a drawer such as the one described above. For example, there is disclosed in Japanese Laid-open Patent Application No. 2003-5611, an image forming apparatus structured so that when a cartridge is inserted into, or remove from, the main assembly of the apparatus, the control panel of the main assembly of the apparatus is retractable to minimize the amount by which the drawer has to be exposed from the main assembly in order to limit the amount by which the center of gravity of the main assembly shifts as the drawer is moved outward of the main assembly.

However, in the case of the structural arrangement disclosed in Japanese Laid-open Patent Application No. 2003-5611, it requires a sub-structure for allowing the control panel to be retracted. Thus, it makes the main assembly complicated in structure.

SUMMARY OF THE INVENTION

The present invention is made in consideration of the above-described issue. Thus, the primary object of the present invention is to provide an image forming apparatus which is structured so that cartridges are inserted into, or removed from, the cartridge supporting member of the apparatus, and which is simple in structure, and yet, is capable of remaining stable in attitude even after its cartridge supporting member is moved into its outermost position, relative to the apparatus main assembly, for cartridge replacement.

According to an aspect of the present invention, there is provided an image forming apparatus comprising a cartridge including at least one of a rotatable photosensitive member and a rotatable developer carrying member for carrying the developer to be supplied to said photosensitive member; and a supporting member configured to detachably supporting said cartridge, said supporting member and being movable between an inside position for permitting mounting of said cartridge to said image forming apparatus and an outside position outside said image forming apparatus in a direction along an axial direction of said photosensitive member or said developer carrying member, wherein said cartridge is mountable to and dismountable from said supporting member, at a position above said supporting member, and wherein when said supporting member is in the outside position in a state that said cartridge is mounted to said supporting member, an upstream end portion of said supporting member with respect to a moving direction from the inside position toward the outside position is inside said image forming apparatus, and wherein when said supporting member is in the outside position, a downstream portion of said supporting member with respect to the moving direction is at a position lower than that when said supporting member is in the inside position.

Further features of the present invention will become apparent from the following description of exemplary embodiments with reference to the attached drawings.

DESCRIPTION OF THE EMBODIMENTS

Embodiment 1

Hereinafter, the present invention is described with reference to a few of the preferred embodiments of the present invention. By the way, the measurements, materials, and shapes of the structural components of the image forming apparatus in each of the following embodiments of the present invention, and the positional relations among the structural components, are not intended to limit the present invention in scope unless specifically noted.

<Image Forming Apparatus>

To begin with, the overall structure of the image forming apparatus A in the first embodiment of the present invention is described along with its image forming operation, with reference drawings.

The image forming apparatus A is an electrophotographic color image forming apparatus, which forms an image on image formation medium with the use of four toners (developer) which are different in color, more specifically, yellow (Y), magenta (M), cyan (C) and black (K) toners. By the way, in this embodiment, a sheet of ordinary paper, OHP film, and the like, is used as the image formation medium.

Figure 1:
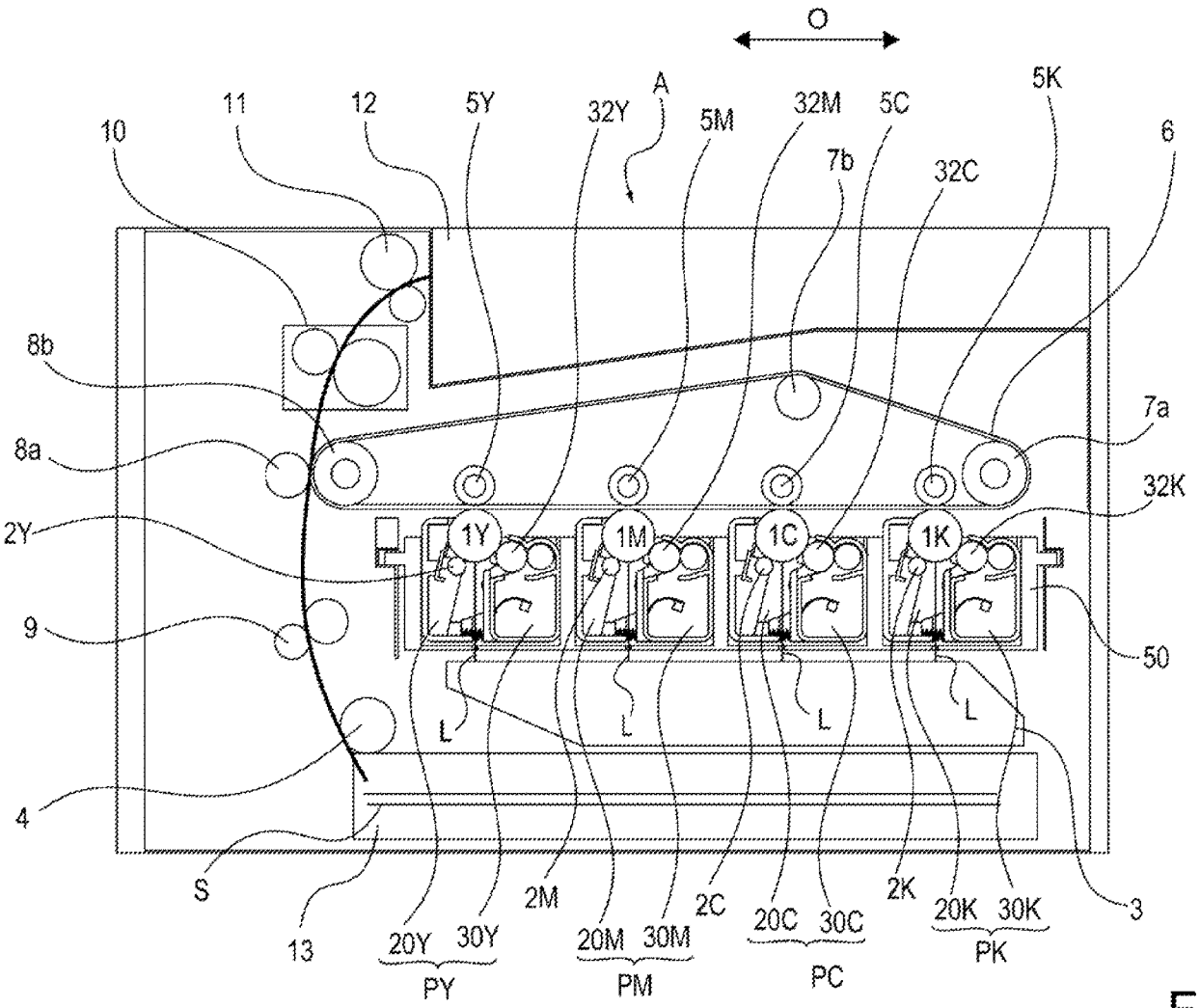
FIG. 1 is a schematic sectional view of a typical image forming apparatus to which the present invention is applicable.

Referring to FIG. 1, the image forming apparatus A has: an image forming portion in which a toner image is transferred onto a sheet of image formation medium; a sheet feeding-conveying portion which delivers a sheet of image formation medium to the image forming portion; and a fixing portion which fixes a toner image to the sheet.

The image forming portion is provided with: process cartridge chambers in which process cartridges P (PY, PM, PC and PK, which contain yellow, magenta, cyan and black toners, respectively) are removably inserted; an intermediary transfer unit; a laser scanner unit; etc.

The intermediary transfer unit is provided with primary transfer rollers 5 (5Y, 5M, 5C and 5K), a cylindrical and endless intermediary transfer belt 6, a secondary transfer roller 8*a*, a belt-backing roller 8*b* (which opposes the secondary transfer roller 8*a*), etc. Further, the intermediary transfer belt 6 is suspended and tensioned by the belt-backing roller 8*b*, and a pair of belt-suspending-tensioning rollers 7*a* and 7*b*.

The process cartridges P are removably supported by a process cartridge drawer 50 (supporting member, which hereafter will be referred to simply as drawer) with which the image forming apparatus A is provided, and which is movable between its innermost position, in which it keeps the process cartridges P in their image forming positions in the image forming apparatus A, and its outermost position, in which it allows the process cartridges to be inserted into, or removed from, the drawer. Further, the process cartridge P is made up of a photosensitive member unit 20 (20Y, 20M, 20C and 20K) and a development unit 30 (30Y, 30M, 30C and 30*k*). The four photosensitive member units 20, which are different in the color of the toner image they form, are the same in structure. Four development units, which are different in the color of the toner they use, are also the same in structure. Further, when the process cartridges P are in their image formation position in the image forming apparatus A, the intermediary transfer belt 6 is above the process cartridges P.

Figure 2:
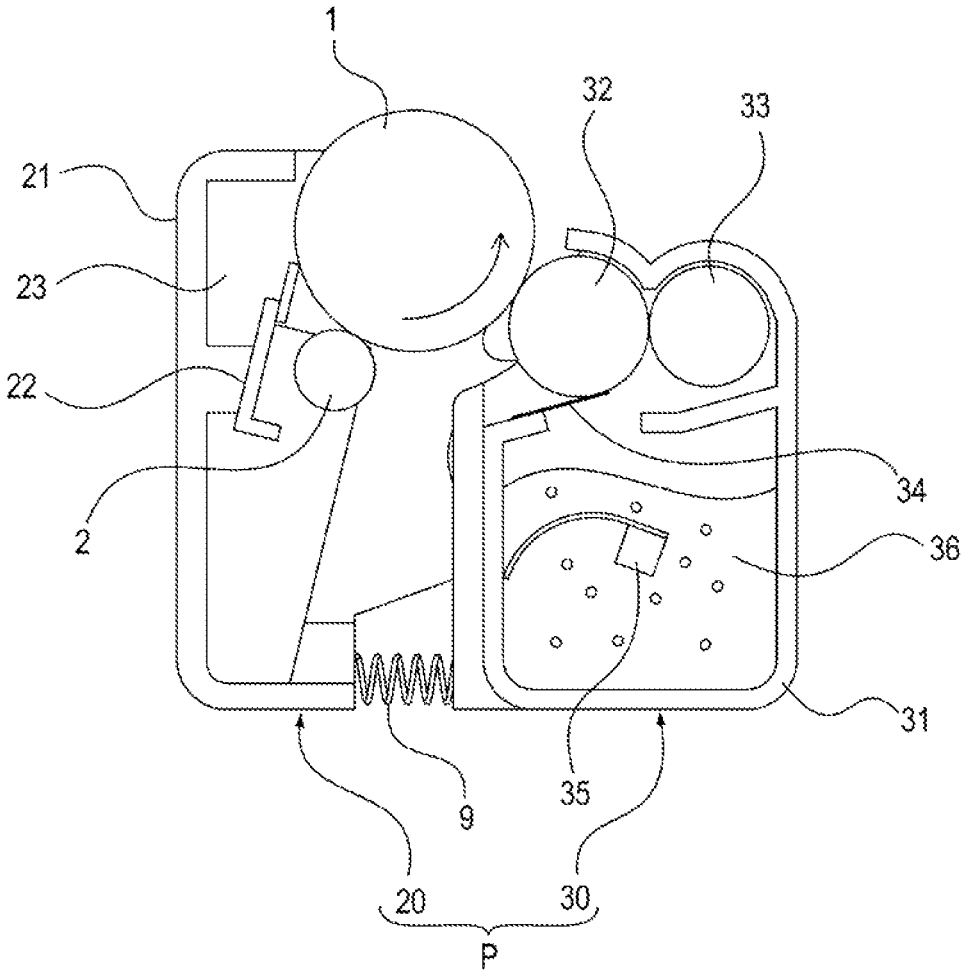
FIG. 2 is a sectional view of a process cartridge.

Referring to FIG. 2, the photosensitive member unit 20 has a frame 21, and the photosensitive drum 1, as an image bearing member, supported by the frame 21. The photosensitive drum 1 is made up of an aluminum cylinder, and a layer of organic photoconductive substance coated on the peripheral surface of the aluminum cylinder. It has also a charge roller 2, a cleaning member 22, and a container 23 for recovered toner. The charge roller 2 is of the so-called contact charging type. That is, it charges the photosensitive drum 1 by being placed in contact with the photosensitive drum 1.

The development unit 30 has a frame 31, and a development roller 32 (developer bearing member), which is supported by the frame 31 in such a manner that its axial line is parallel to the axial line of the photosensitive drum 1. It has also a supply roller 33, a development blade 34, a developer stirring-conveying member 35, and a developer storing portion 36. The toner in the developer storing portion 36 is sent to the supply roller 33 by the stirring-conveying member 35. It is coated on the peripheral surface of the development roller 32 by a combination of the supply roller 33, and the development blade 34 kept pressed upon the peripheral surface of the development roller 32, while the toner in the developer is given electric charge.

Figure 3A:
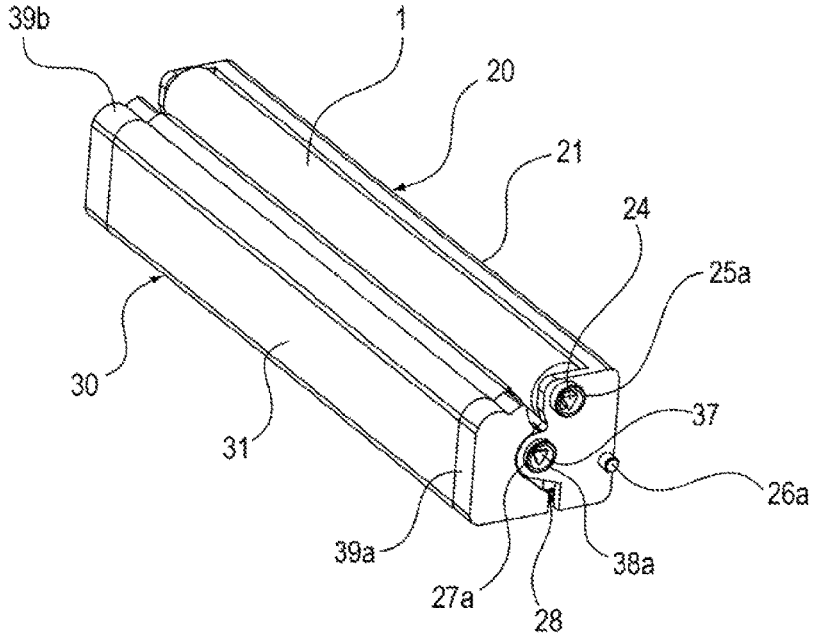
FIGS. 3A and 3B are perspective views of the process cartridge.

Next, referring to FIG. 3A, the photosensitive member unit 20 is provided with the first coupling member 24, which is attached to one of the lengthwise ends of the photosensitive drum 1 in terms of the direction parallel to the axial line of the photosensitive drum 1. The first coupling member 24 rotates by receiving driving force from a drum coupling member 15 (FIG. 9) with which the main assembly of the image forming apparatus A is provided. Thus, the photosensitive drum 1 rotates. By the way, referring to FIG. 9, the drum coupling members 15 are disposed in such a manner that they are horizontally align in parallel with equal intervals.

The peripheral surface of the first coupling member 24 is covered with a cylindrical rib, making up a positioning portion 25*a* which is regulated in position by the positioning portion of the drawer 50. Further, the process cartridge P is provided with a rotation regulating portion 26*a*, which is regulated in position by the rotation regulating portion of the drawer 50 and is positioned lower than the positioning portion 25*a*.

Figure 3B:
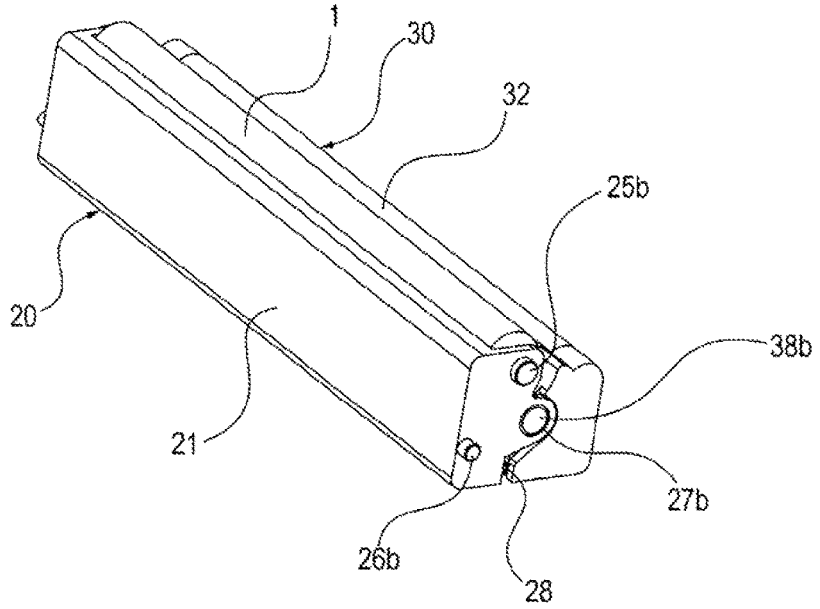

Next, referring to FIG. 3B, the other end of the photosensitive member unit 20 is provided with a positioning portion 25*b*, which is in the form of a cylindrical protrusion which is protrusive in the direction parallel to the axial line of the photosensitive drum 1 and is regulated in position by the counterpart of the drawer 50. Further, the other end of the photosensitive member unit 20 is provided with a rotation regulating portion 26*b*, which is regulated in position by the counterpart of the drawer 50 and is positioned lower than the positioning portion 25*b*.

These positioning portions 25*a* and 25*b*, and rotation regulating portions 26*a* and 26*b*, have the function of positioning the process cartridge P when the process cartridge P is inserted into the drawer 50. By the way, the structure of the drawer 50, and the insertion and removal of the process cartridge P into, or from, the drawer 50, are described later.

Figure 9:
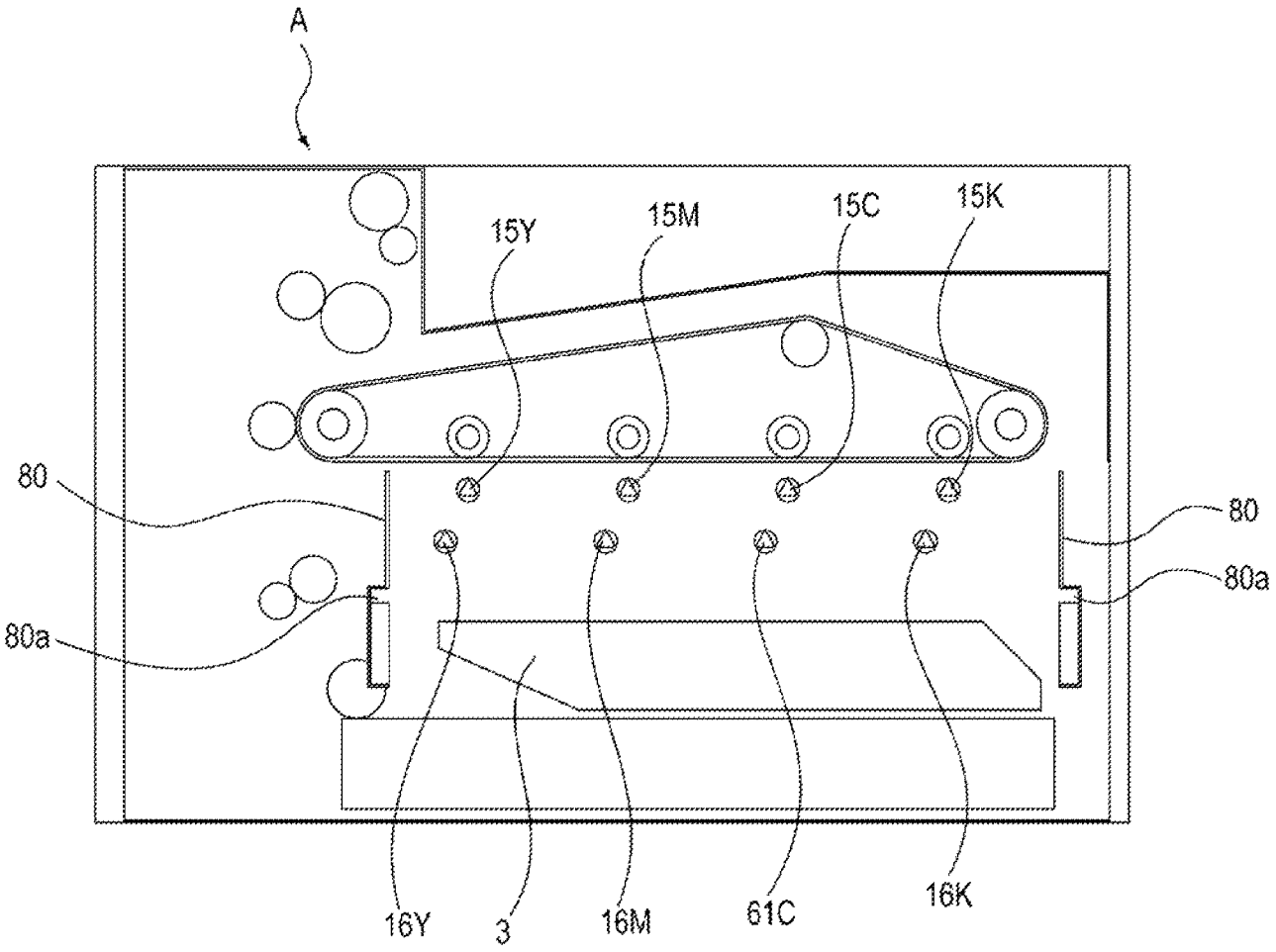
FIG. 9 is a schematic sectional view of the image forming apparatus when its drawer is not in the main assembly of the apparatus.

Also referring to FIG. 3A, the development unit 30 is provided with the second coupling member 37, which is attached to one of the lengthwise ends of the development roller 32, in terms of the direction parallel to the axial line of the development roller 32. The second coupling member 37 receives driving force from the development unit coupling member 16 (FIG. 9) with which the main assembly of the image forming apparatus A is provided, whereby it rotates the development roller 32, supply roller 33, and stirring-conveying member 35 by way of an unshown set of intermediary gears. By the way, the image forming apparatus A is structured so that the development roller coupling members 16 horizontally align with equal intervals, as shown in FIG. 9.

Further, the peripheral surface of the second coupling member 37 is covered with cylindrical ribs, making up an engaging portion 38*a*. The engaging portion 38*a* is a part of a side cover 39*a*, which is fixed to the exterior of the developer storing portion 36. Further, referring to FIG. 3B, a side cover 39*b*, which is at the other end of the development unit 30 is provided with an engaging portion 38*b*. By the way, the second coupling member 37 is rotationally movable relative to the engaging portion 37*a*.

These engaging portions 38*a* and 38*b* are engaged into the holes 27*a* and 27*b*, respectively, with which the frame 21 of the photosensitive member unit 20 is provided, whereby the photosensitive member unit 20 and development unit 30 are connected to each other so that they are pivotally movable relative to each other about the engaging portions 38*a* and 38*b*. Further, there is provided a pair of springs between the photosensitive member unit 20 and development unit 30. These springs generate a preset amount of pressure which keeps the development roller 32 in contact with the photosensitive drum 1.

Next, the image forming operation of the image forming apparatus A is described. First, the control portion (unshown) of the image forming apparatus A outputs an image formation start signal. As the signal is outputted, the sheets S of recording medium stored in layers in the sheet storage portion 13 are sent out one by one to the image forming portion by a pickup roller 4 as shown in FIG. 1.

Meanwhile, in the image forming portion, the peripheral surface of the photosensitive drum 1 is charged by the charge roller 2. Then, the laser scanner unit 3 projects a beam L of laser light, which it outputs from its unshown internal light source while modulating the beam L according to the information of the image to be formed, upon the peripheral surface of the photosensitive drum 1. As a result, an electrostatic latent image, which reflects the information of the image to be formed, is formed on the peripheral surface of the photosensitive drum 1. Next, development bias is applied to the development roller 32, whereby toner is adhered to the electrostatic latent image on the peripheral surface of the photosensitive drum 1, from the development roller 32, yielding thereby a toner image.

After the formation of the toner images on the photosensitive drums 1, one for one, the toner images are sequentially transferred (primary transfer) onto the intermediary transfer belt 6 by the application of such bias that is opposite in polarity from the toner charge, to the primary transfer roller 5. As a result, a full-color toner image is synthetically formed of the yellow, magenta, cyan, and black toner images, on the intermediary transfer belt 6.

Next, the toner images transferred (primary transfer) onto the intermediary transfer belt 6 are made to reach the secondary transferring portion formed by the secondary transfer roller 8*a*, and belt-backing roller elastic layer 8*b*, which are on the downstream side of the image forming portion, by the rotation of the intermediary transfer belt 6, which is caused by the driving force which the intermediary transfer belt 6 receives from the unshown driving force source. Meanwhile, a sheet of image formation medium is introduced into the secondary transferring portion by a pair of registration rollers 9 with a preset control timing. Consequently, the toner images are transferred onto the sheet.

After the transfer of the toner images onto the sheet of image formation medium, the sheet is introduced into a fixing device 10, in which it is heated, while being pressed, in the fixation nip of the fixing device 10. Consequently, the toner images are fixed to the sheet. Thereafter, the sheet is moved out of the fixing device 10, and is discharged as a full-color print, onto a delivery portion 12 by a pair of discharge rollers 11. This is how a full-color image is formed on a sheet of image formation medium by the image forming operation of the image forming apparatus A.

By the way, the toner remaining on the peripheral surface of the photosensitive drum 1 after the transfer of the toner images onto the intermediary transfer belt 6 is removed by the cleaning member 22, and then, is stored in the container 23 for the recovered toner.

If the toner in the developer storing portion 36 is entirely consumed during an image forming operation, a user can replace the process cartridge(s) P in the image forming apparatus A to continue the image forming operation.

<General Description of Drawer>

Next, the drawer 50 is described. First, the general description of the drawer 50 is given.

Figure 4A:
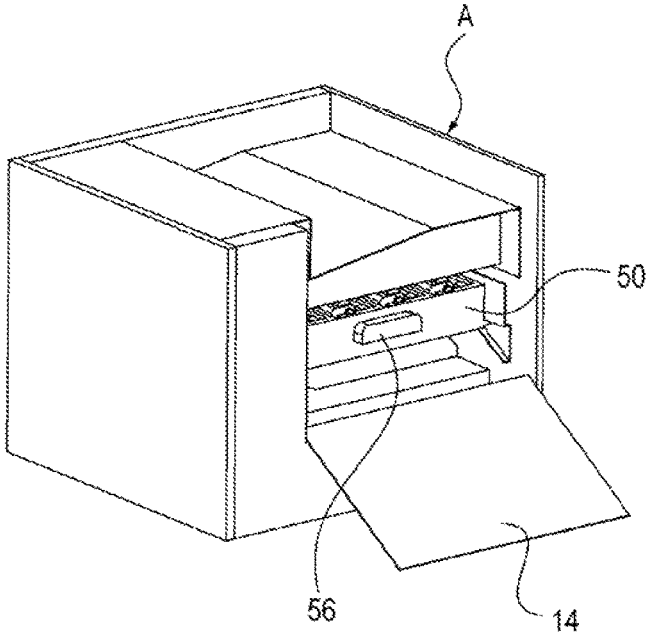
FIGS. 4A and 4B are perspective views of the image forming apparatus when control panel is retracted, but drawer is in its innermost position, and when control panel is retracted, and drawer is in its outermost position, respectively) for showing how the drawer is partially pulled out of the main assembly of the image forming apparatus.
Figure 4B:
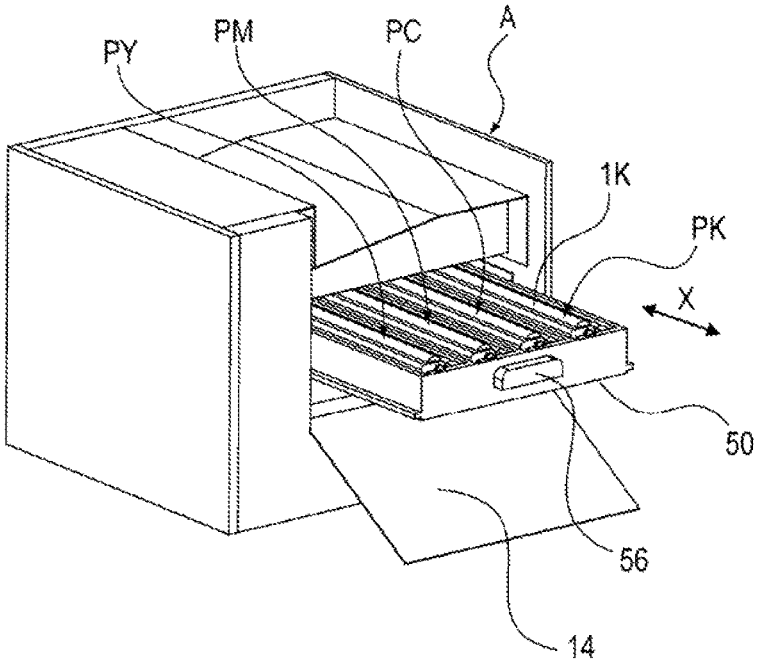

Referring to FIGS. 4A and 4B, the drawer 50 is movable in the direction indicated by an arrow mark X (pushed into, or pulled out of, main assembly of image forming apparatus A) through an opening which is exposed as the door 14 with which the main assembly of the image forming apparatus A is provided is opened. That is, when the door 14 is open, the drawer 50 can be moved from its innermost position to its outermost position.

Referring to FIG. 4B, as the process cartridges P (PY, PM, PC and PK) are inserted into the drawer 50, they are disposed in the drawer 50 so that the axial line of the photosensitive drum 1 and that of the development roller 32 in each process cartridge P become parallel to the moving direction of the drawer 50. That is, the image forming apparatus A is structured so that the drawer 50 is movable in the direction parallel to the axial line of the photosensitive drum 1 and that of the development roller 32.

After the proper insertion of the four process cartridges P (PM, PM, PC and PK) into the drawer 50, they are parallel to each other and their lengthwise direction is parallel to the moving direction of the drawer 50. As the door 14 is closed after the drawer 50 is moved into its inner most position, the drum coupling member 15 and developer coupling member 16, which remain retracted in one of the lateral walls of the cartridge chamber when the door 14 is open, are made to enter the process cartridge P by the closing movement of the door 14. Further, the intermediary transfer belt 6 is made to lower itself by the closing movement of the door 14. As the drawer 50 is moved into in its innermost position in the main assembly of the image forming apparatus, the process cartridges P in the drawer 50 are properly positioned for image formation, relative to the main assembly of the image forming apparatus A.

<Insertion of Process Cartridges into Drawer>

Next, the insertion of the process cartridges P into the drawer 50 is described. First, the process cartridge chambers of the drawer 50 are described about their structure.

Figure 5:
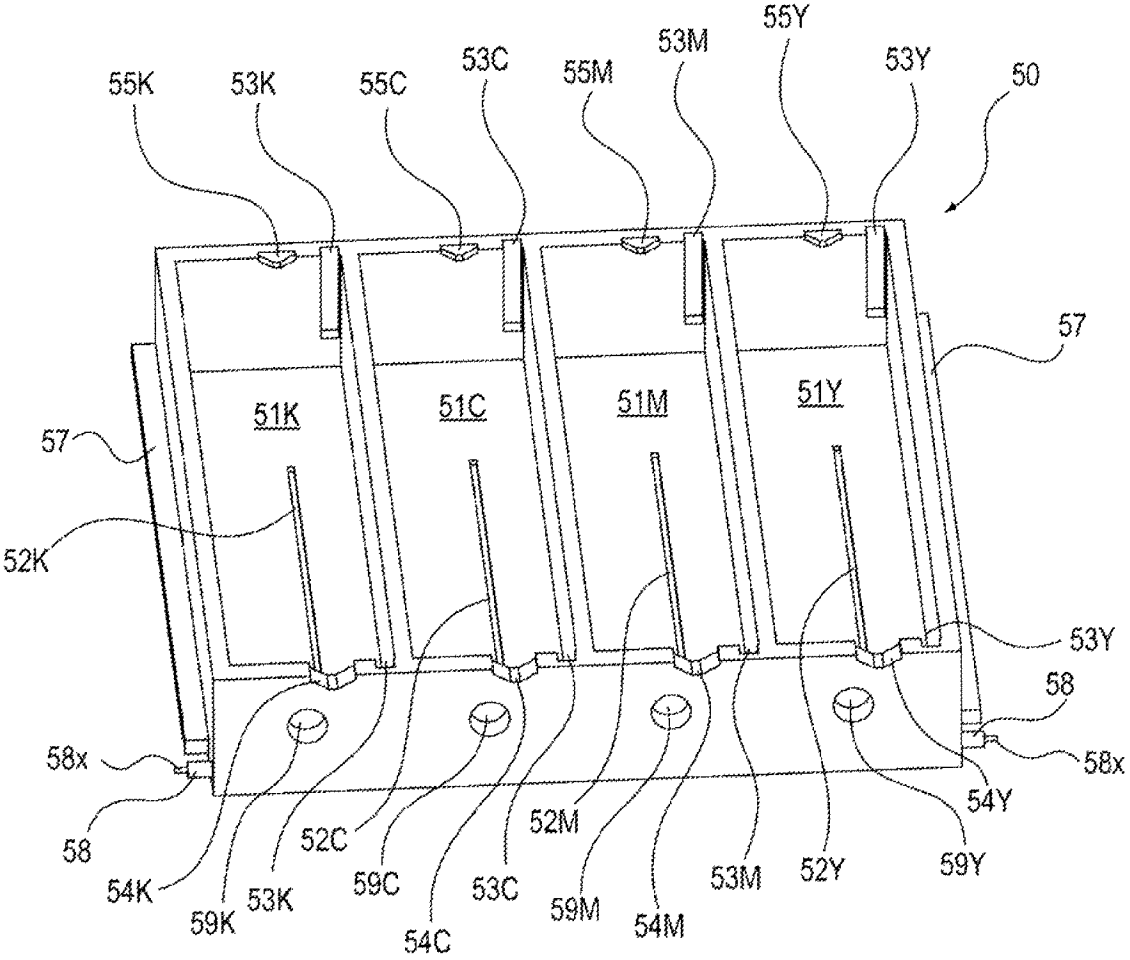
FIG. 5 is a perspective view of the drawer.
Figure 6:
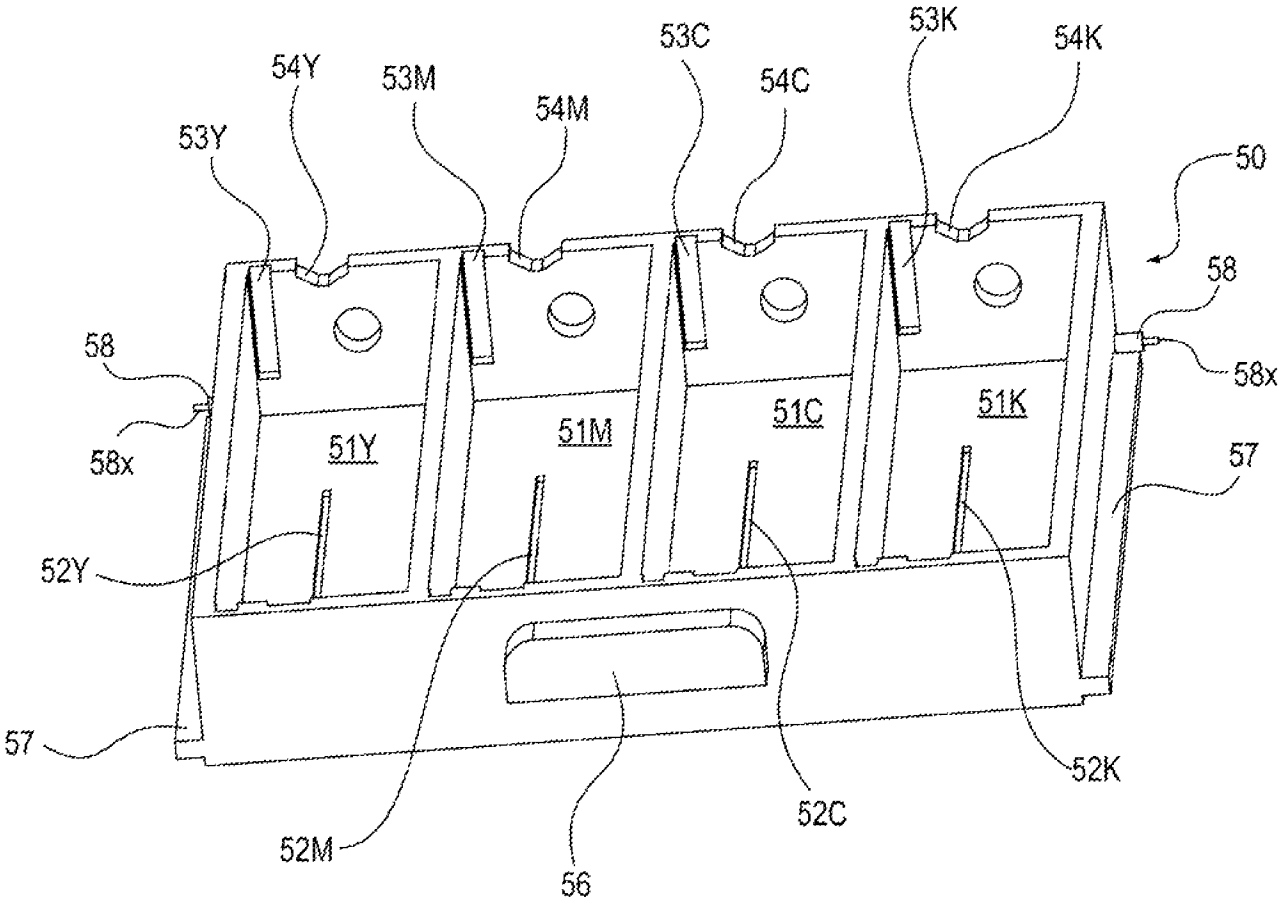
FIG. 6 is a perspective view of the drawer as seen from an angle different from the angle from which the drawer is seen in FIG. 5.

FIG. 5 is a perspective view of the drawer 50. FIG. 6 is a perspective view of the drawer 50 as seen from the opposite direction from the direction in which the drawer is seen in FIG. 5. Referring to FIGS. 5 and 6, the drawer 50 is provided with four process cartridge chambers 51 (51Y, 51M, 51C and 51K) which are parallel to each other. The bottom wall of each chamber 51 is provided with an opening 52 (52Y, 52M, 52C and 52K), through which the beam L of laser light is projected upon the peripheral surface of the photosensitive drum 1 from the laser scanner unit 3.

In terms of the moving direction of the drawer 50, each end of the each process cartridge chamber 51 (which hereafter may be referred to simply as cartridge chamber) is provided with a guiding portion 53 (53Y, 53M, 53C and 53K) for guiding the process cartridge P into a preset position in the cartridge chamber 51. The guiding portion 53 vertically extends. Further, the lengthwise ends of each cartridge chamber 51 are provided with a pair of V-shaped positioning portions 53 and 54 (53Y, 53M, 53C and 53K; 54Y, 54M, 54C and 54K, respectively), one for one, for positioning the process cartridge P relative to the drawer 50.

Further, the inward end of each cartridge chamber is provided with an opening 59 (59Y, 59M, 59C and 59K) through which the development roller coupling member 16 is made to enter the cartridge chamber 51 by the closing movement of the door 14.

Further, the downstream end of the drawer 50 in terms of the outward movement of the drawer 50 is provided with a handgrip which is for a user to take hold of the drawer 50.

Further, each of the side walls the drawer 50 in terms of the moving direction of the drawer 50 is provided with a combination of a rib 57 (guiding portion) and a boss 58, which is guided by a corresponding guiding member 80, with which the main assembly of the image forming apparatus A is provided. Further, the tip of each boss 58 is provided with an engagement pin 58*x*. By the way, the structure of the guiding member 80, the movement of the drawer 50, etc., are described later in greater detail.

Next, the process for inserting the process cartridges P into the drawer 50 is described. By the way, it is only the insertion of the process cartridge PK that is described here. The insertion of the other process cartridges P (PY, PM and PC) is the same as that of the process cartridge PK.

Figure 7:
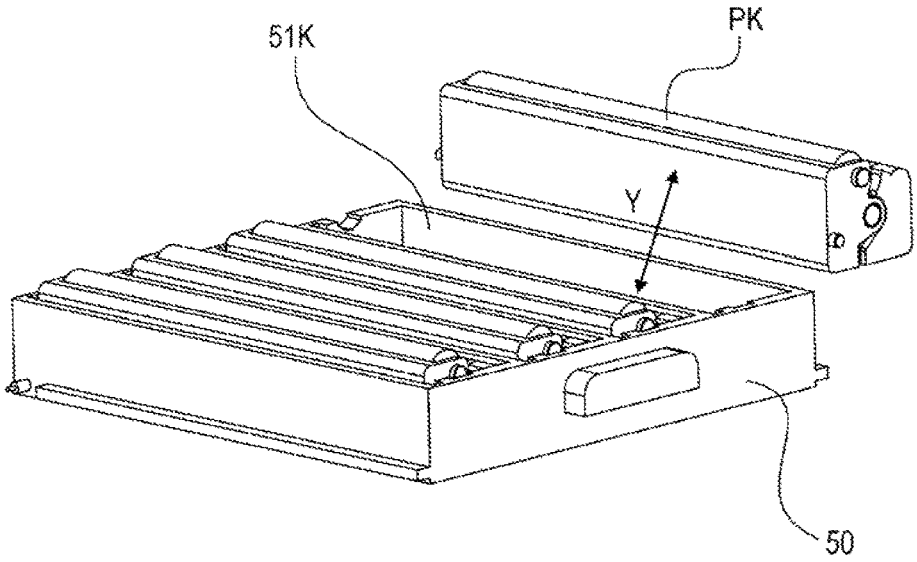
FIG. 7 is a perspective view of a combination of the drawer and the process cartridges, and is for describing how the process cartridges are inserted into the drawer.

FIG. 7 is a perspective view of the drawer 50 and the process cartridges P when the process cartridge PK is being inserted into the drawer 50 while the other process cartridges P are already in the drawer 50. The process cartridge PK is to be inserted into the process cartridge chamber 51K from above the chamber 51K in the direction indicated by an arrow mark Y in FIG. 7.

Figure 8:
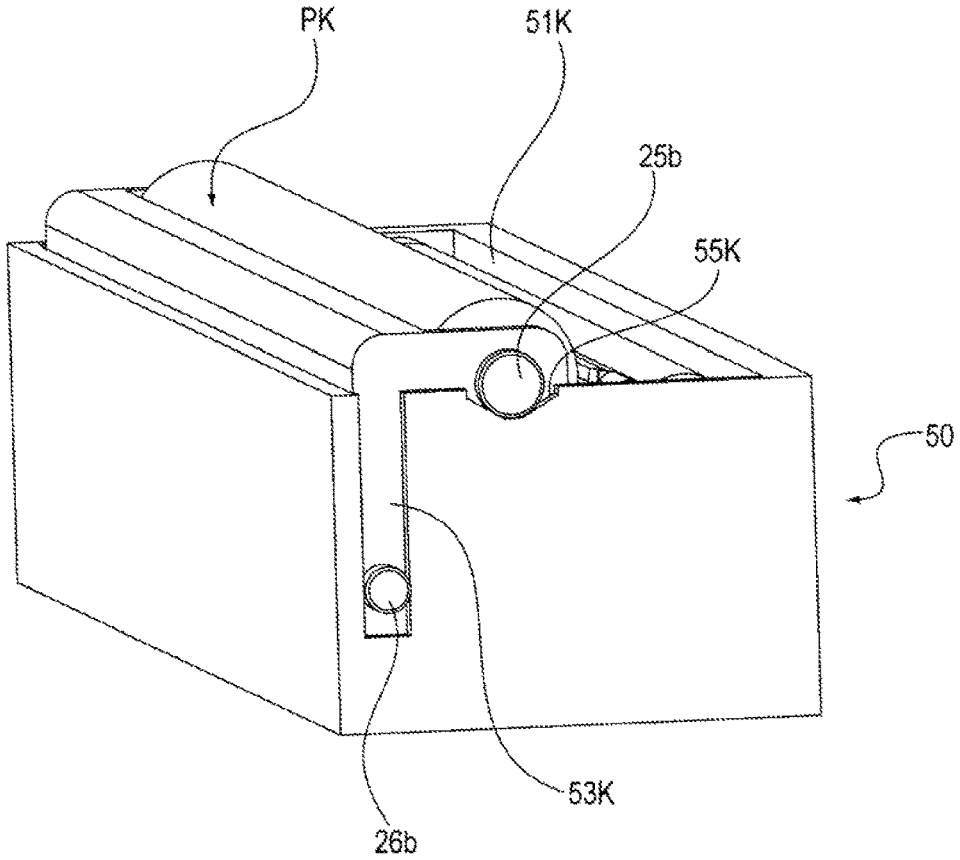
FIG. 8 is a perspective view of a part of the drawer and one of the process cartridges, and is for describing how the process cartridge is inserted into the drawer.

Next, referring to FIG. 8, as the process cartridge PK begins to be inserted into the drawer 50 in the above-described manner, the rotation regulating portion 26*b* of the process cartridge PK fits into the guiding portion 53K of the drawer 50, whereby the process cartridge PK is guided downward. As the process cartridge PK is inserted further into the drawer 50, the positioning portion 25*b* of the process cartridge PK comes into contact with the positioning portion 55K of the drawer 50. The positioning portion 55K is in the form of a letter V. Therefore, as the positioning portion 25*b*, which is cylindrical, comes into contact with the positioning portion 55K, the process cartridge PK becomes properly positioned. Further, the rotation regulating portion 26*b* comes into contact with the lateral surface of the guiding portion 53K, setting in attitude the photosensitive drum 1, etc., in the process cartridge PK, in terms of the rotational direction of the photosensitive drum 1. That is, the position of the process cartridge PK in the drawer 50 is set by the combination of the positioning portion 25*b* and rotation regulating portion 26*b*.

<Movement of Drawer>

Next, the movement of the drawer 50 is described. As described above, the drawer 50 is movable between its innermost position in the image forming apparatus A, and its outermost position relative to the main assembly of the image forming apparatus A. The innermost position of the drawer 50 is where the drawer 50 holds the process cartridges P for image formation, and the outermost position of the drawer 50 is where the drawer 50 allows the process cartridges P to be inserted into, or removed from, the drawer 50.

First, referring to FIG. 9, the process cartridge chambers 51 of the main assembly of the image forming apparatus A are described about their structure.

Referring to FIG. 9, the image forming apparatus A is provided with a pair of drawer guiding members 80 which opposes each other across the drawer chamber in the image forming apparatus A. Each guiding member 80 is provided with a drawer engaging portion 80*a*. Thus, the movement of the drawer 50 is guided by the drawer engaging portions 80*a*. Each drawer engaging portion 80*a* extends roughly horizontally so that it can guide the drawer 50 from the innermost position of the drawer 50 to the outermost position of the drawer 50.

Next, the relationship between the guiding members 80 and drawer 50 is described. FIG. 10 is a perspective view of a combination of one of the guiding members 80 and the drawer 50. It is for showing the relationship between the guiding members 80 and drawer 50. By the way, FIG. 10 shows the combination when the drawer 50 is in its innermost position. Further, FIG. 10 does not show certain portions of the combination, for the sake of simplifying the description.

Figure 10A:
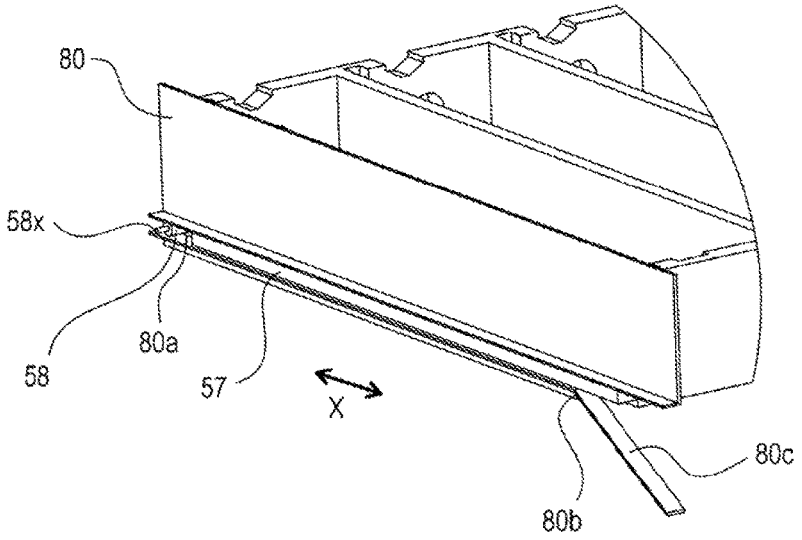
FIGS. 10A and 10B are perspective views of a combination of the drawer and guiding member, and are for showing the relationship between the drawer and guiding member.
Figure 10B:
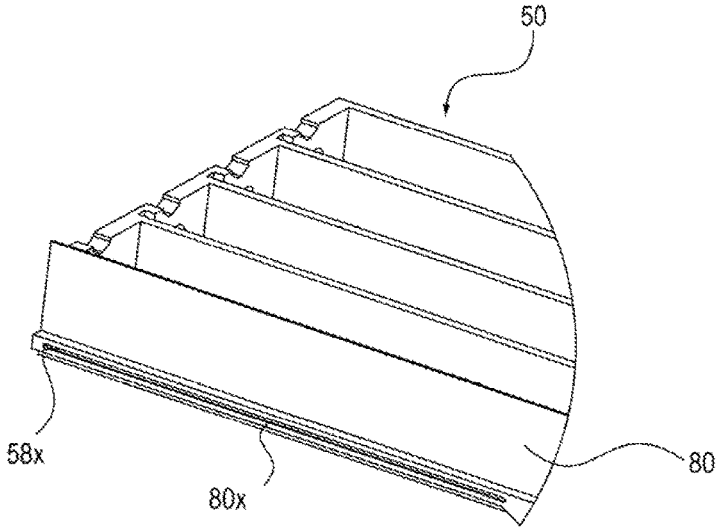

Referring to FIG. 10A, the ribs 57 and bosses 58 of the drawer 50 fit into the engaging portions 80*a* of the guiding members 80, one for one, enabling thereby the drawer 50 to be moved in the direction indicated by an arrow mark X. Next, referring to FIG. 10B, the pin 58*x* is put through the guiding groove 80*x* of the guiding member 80.

Each guiding member 80 has the engaging portion 80*a*, a downwardly slanted portion 80*b*, and a bend 80*b* which is the border between the engaging portion 80*a* and downwardly slanted portion 80*c*.

Next, the movement of the drawer 50 from its innermost position to its outermost position is described.

Figure 11A:
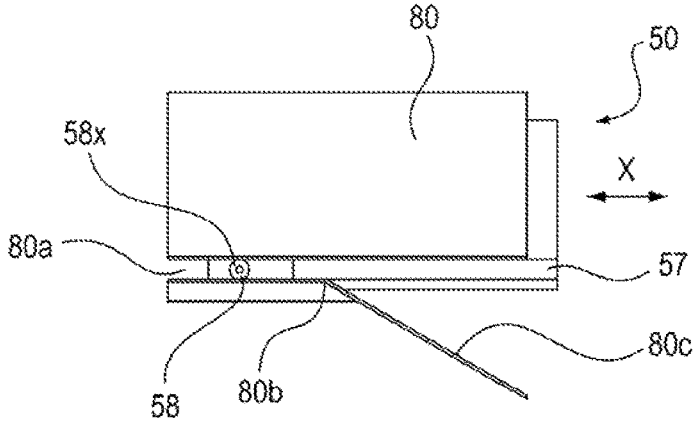
FIGS. 11A, 11B, and 11C are side views of a combination of the drawer and guiding member, and are for showing the relationship between the drawer and guiding member.

Referring to FIG. 11A, as the drawer 50 is pulled outward, it begins to slide outward, that is, in the direction indicated by the arrow mark X, while being guided by the guiding members 80, with its guiding portions 57 and guiding bosses 58 fitted in the engaging portions 80*a*.

Figure 11B:
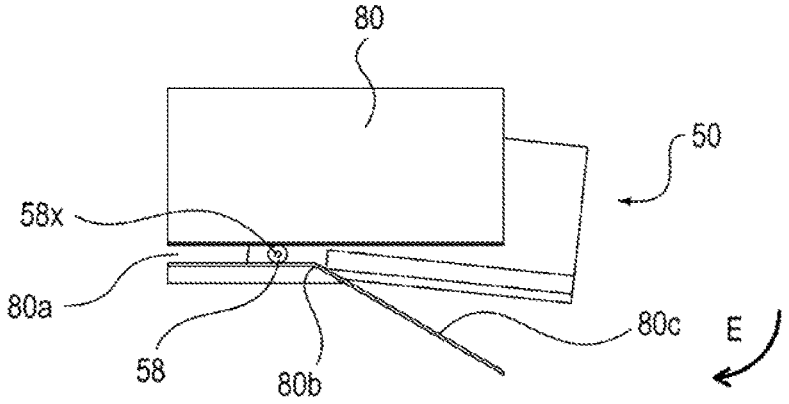

Next, referring to FIG. 11B, as the drawer 50 is moved further outward, the guiding portion 57 moves past the bend 80*b* of the guiding member 80. As the guiding portion 57 moves past the bend 80*b*, the drawer 50 is made to downwardly pivot (direction indicated by arrow mark E) by its own weight about the bosses 58, with which the upstream end of the drawer 50 is provided in terms of the direction in which the drawer 50 is moved when the drawer 50 needs to be outwardly moved. As the drawer 50 downwardly pivots, the guiding portion 57 of the drawer 50 comes into contact with the top surface of the slanted portion 80*c* of the guiding member 80, whereby the drawer 50 is controlled in attitude (angle).

Figure 11C:
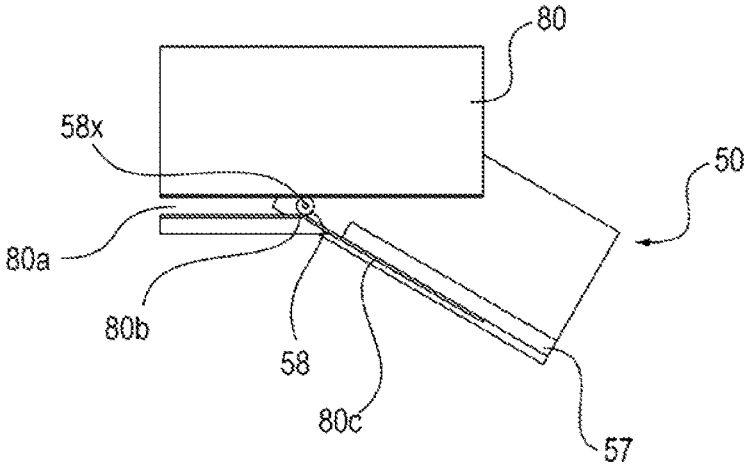

Next, referring to FIG. 11C, as the drawer 50 is moved further outward, the guiding portion 57 of the drawer 50 remains in contact with the top surface of the slanted portion 80*c*.

Figure 12:
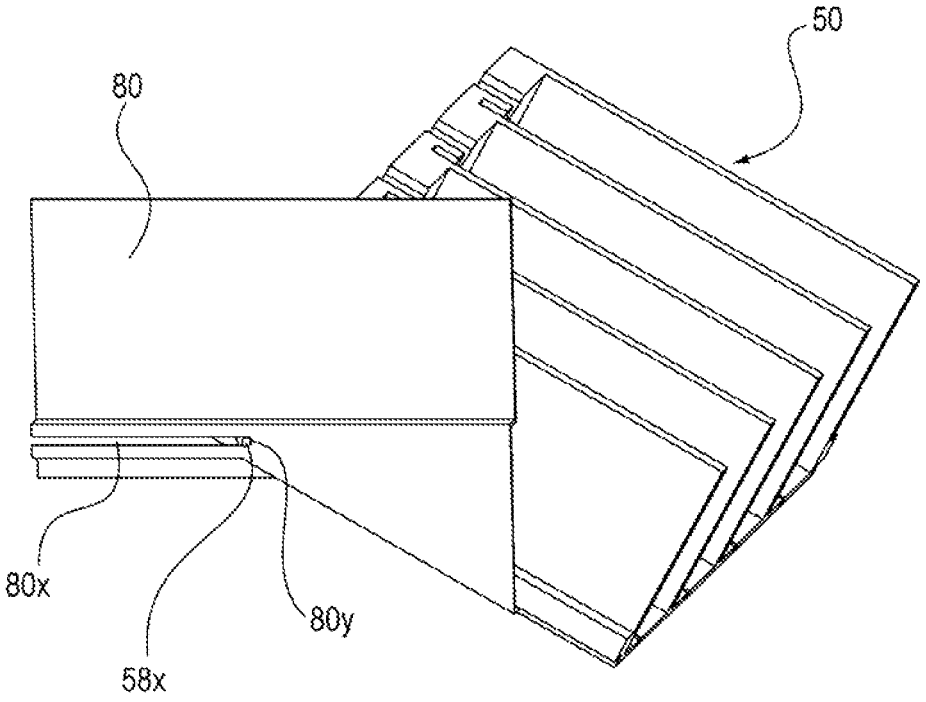
FIG. 12 is a combination of a side view of the guiding member and a perspective view of the drawer, and is for showing the state of the combination when the drawer is in its outermost position.

FIG. 12 is a combination of a side view of the drawer 50 and a perspective view of the drawer 50 when the drawer 50 is in its outermost position. As is evident from FIG. 12, as the pin 58*x* of the boss 58 comes into contact with the outward end 80*y* of the groove 80*x* of the guiding member 80, the drawer 50 is locked into its outermost position. When the drawer 50 is in its outermost position, it is supported by the main assembly of the image forming apparatus A (apparatus main assembly) while remaining tilted in such an attitude that the downstream end of the drawer 50, in terms of the direction in which the drawer 50 is moved from its innermost position in the apparatus main assembly to its outermost position, is positioned lower than when the drawer 50 is in its innermost position.

By the way, the movement of the other side of the drawer 50 is the same as the above-described one. The movement of the drawer 50, which occurs when the drawer 50 is moved from its outermost position to its innermost position, is the reverse of the above-described one.

Figure 13:
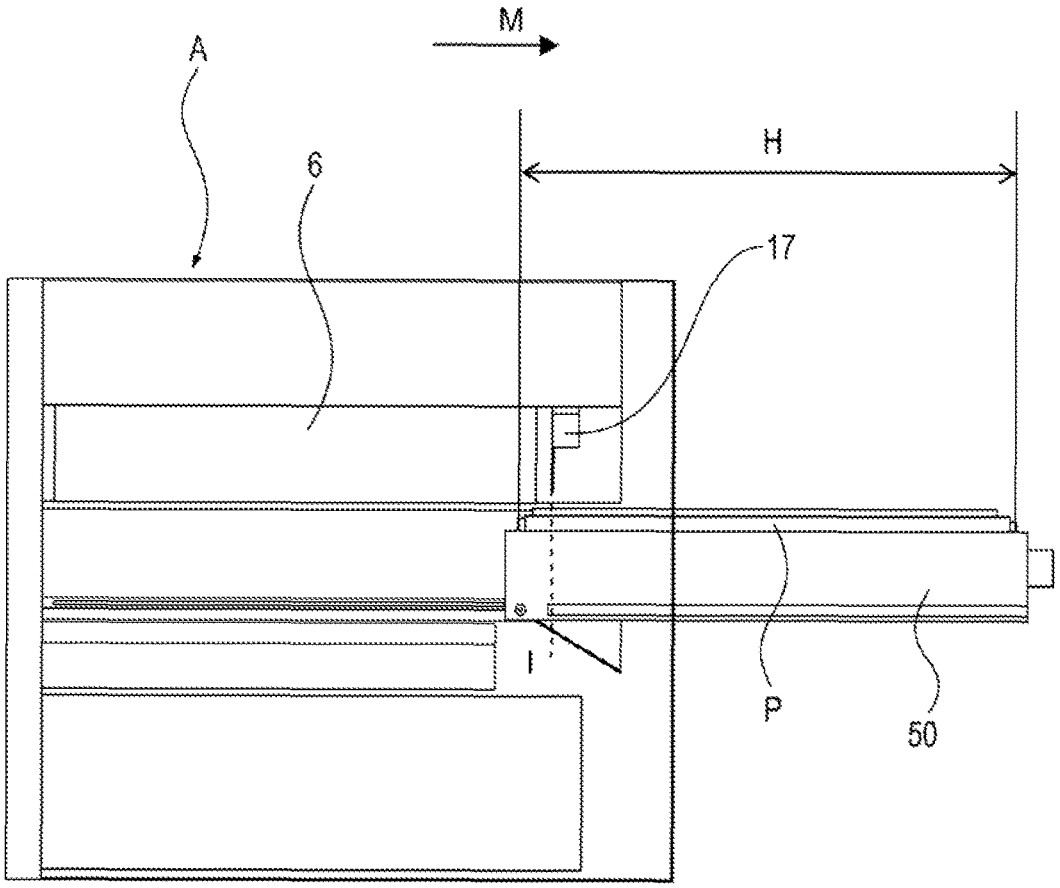
FIG. 13 is a phantom side view of the image forming apparatus when its drawer, which cannot be tilted, is in its outermost position.
Figure 14:
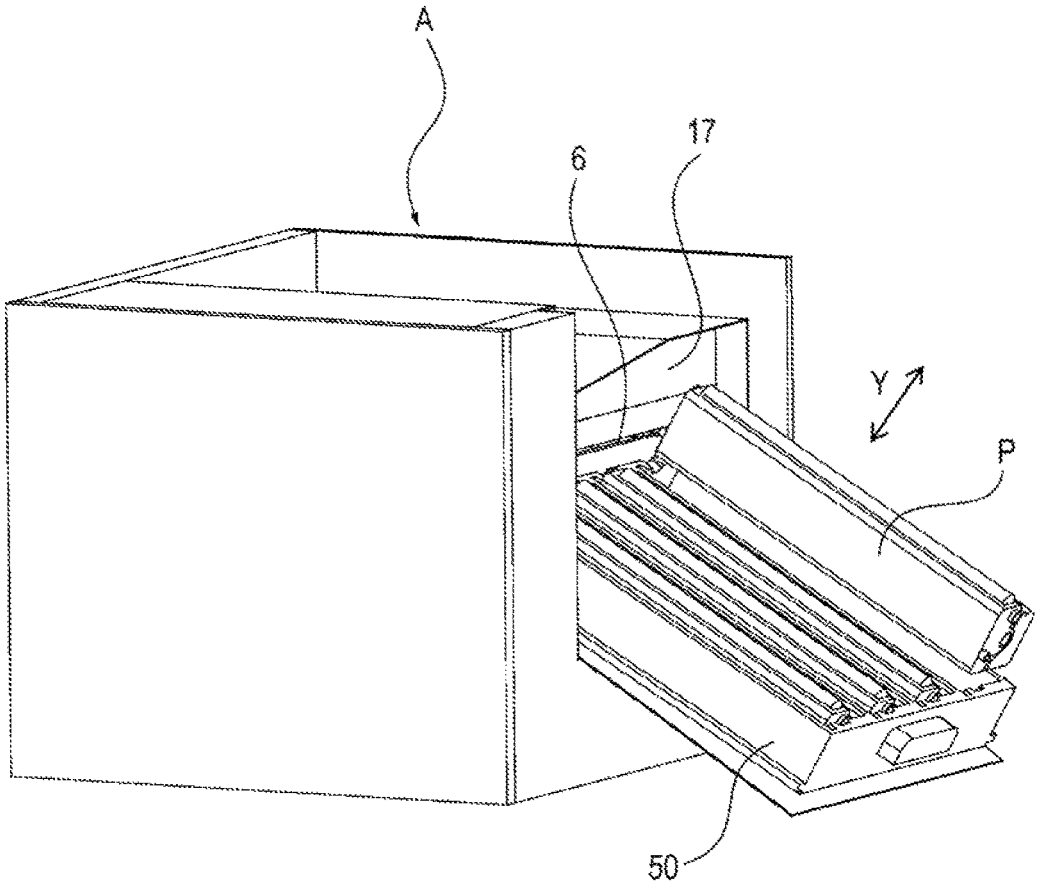
FIG. 14 is a perspective view of the image forming apparatus when its drawer is in its outermost position, that is, cartridge insertion (removal) position, and is for showing how the cartridge is removed from the drawer.

FIG. 13 is a partially phantom side view of a combination of the main assembly of the image forming apparatus A and drawer 50 when the drawer 50 is in its outermost position, without being tilted. When the drawer 50 is in the state shown in FIG. 13, the upstream end, in terms of the direction (indicated by arrow mark M) in which the drawer 50 is moved from its innermost position to its outermost position, of the process cartridge P in the drawer 50 is in the main assembly of the image forming apparatus A. That is, in terms of the direction indicated by the arrow mark M, the upstream end portion of the process cartridge P is on the upstream side of the hypothetical extension I of the inner cover 17 of the image forming apparatus A. This statement that the upstream end portion is in the image forming apparatus A means that the upward projection H of the process cartridge P overlaps with the inner cover 17 for covering the various internal portions of the main assembly of the image forming apparatus A, and the like. Thus, if a user tries to move the process cartridge P upward to remove the process cartridge P from the drawer 50, the process cartridge P collides with the inner cover 17, etc., of the image forming apparatus A, making it impossible for the process cartridge P to be removed from the drawer 50.

Besides, if the image forming apparatus A is structured so that the drawer 50 can be almost entirely pulled out of the main assembly of the image forming apparatus A to prevent the upward projection H of the process cartridge P from overlapping with the other components of the image forming apparatus A, the distance by which the drawer 50 is moved outward of the main assembly of the image forming apparatus A becomes substantial, increasing thereby the amount of the shift of the center of gravity of the image forming apparatus A. Thus, it becomes difficult to keep the image forming apparatus A stable in attitude.

In comparison, in this embodiment, when the drawer 50 is in its outermost position, not only is the upstream end portion of the process cartridge P in the main assembly of the image forming apparatus A, but also, the drawer 50 is supported by the main assembly of the image forming apparatus A in such an angle that the downstream portion of the drawer 50, in terms of the direction in which the drawer 50 is moved when the drawer 50 is moved from its innermost position to its outermost position, is positioned lower than when the drawer 50 is in its innermost position.

Figure 23:
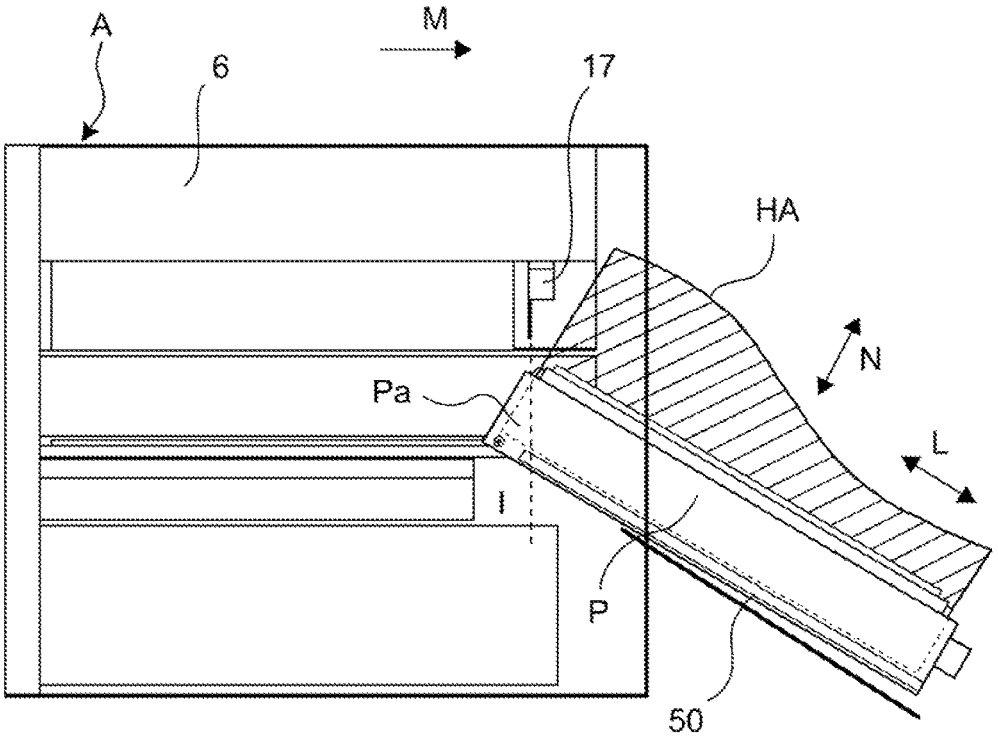
FIG. 23 is a schematic phantom side view of the image forming apparatus when the drawer is in its outermost position.

Since the image forming apparatus A is structured as described above, it is possible to prevent the process cartridges P from colliding with the main assembly of the image forming apparatus A, without requiring virtually the entirety of the drawer 50 to be moved out of the main assembly of the image forming apparatus A, as shown in FIG. 11, when the process cartridges P are inserted into, or removed from, the drawer 50. Therefore, the image forming apparatus A in this embodiment is smaller in the amount by which the center of gravity of its main assembly shifts when the process cartridges P in the drawer 50 are replaced. Therefore, the image forming apparatus A in this embodiment remains stable in attitude during the replacement of the process cartridges P. That is, when the drawer 50 remains tilted as shown in FIG. 23, a part Pa (upstream end portion in terms of direction M) of each process cartridge P in the drawer 50 is on the upstream side of the hypothetical extension I of the inner cover 17. By the way, the part Pa of the process cartridge P corresponds to the upstream portion of the drawer 50 relative to the dotted line in the phantom view of the image forming apparatus A. Further, since the drawer 50 is tilted, the upstream end portion Pa of the drawer 50 is positioned so that when the process cartridge P is inserted into, or removed from, the drawer 50, the path HA (which corresponds to upward projection H in FIG. 13) does not overlap with the inner cover 17, and the like, of the image forming apparatus A. Therefore, the process cartridges P can be easily inserted into, or removed from, the drawer 50. By the way, the direction N in which the process cartridges P are to be moved to be inserted into, or removed from, the drawer 50 is perpendicular to the lengthwise direction L of the process cartridge P, and also, the direction in which the process cartridges P are arranged in tandem (direction indicated by an arrow mark O in FIG. 1). The path HA is the path of the process cartridge P when the process cartridge P is moved in the direction N from the drawer 50.

Embodiment 2

Next, the present invention is described with reference to the image forming apparatus A in the second embodiment of the present invention, using drawings. The portions of the image forming apparatus A in this embodiment, which are the same in description as the counterparts in the above-described first embodiment, are given the same drawings and referential codes, respectively, and are not described here.

Figure 15A:
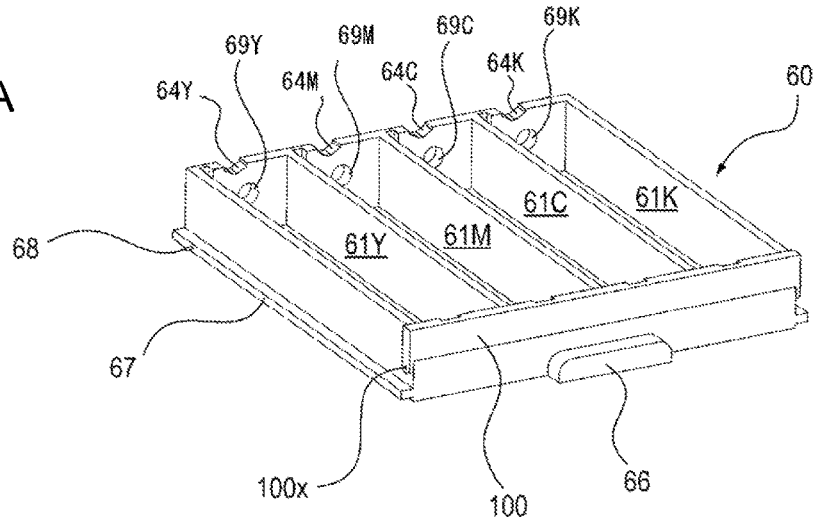
FIGS. 15A and 15B are perspective view of the drawer.
Figure 15B:
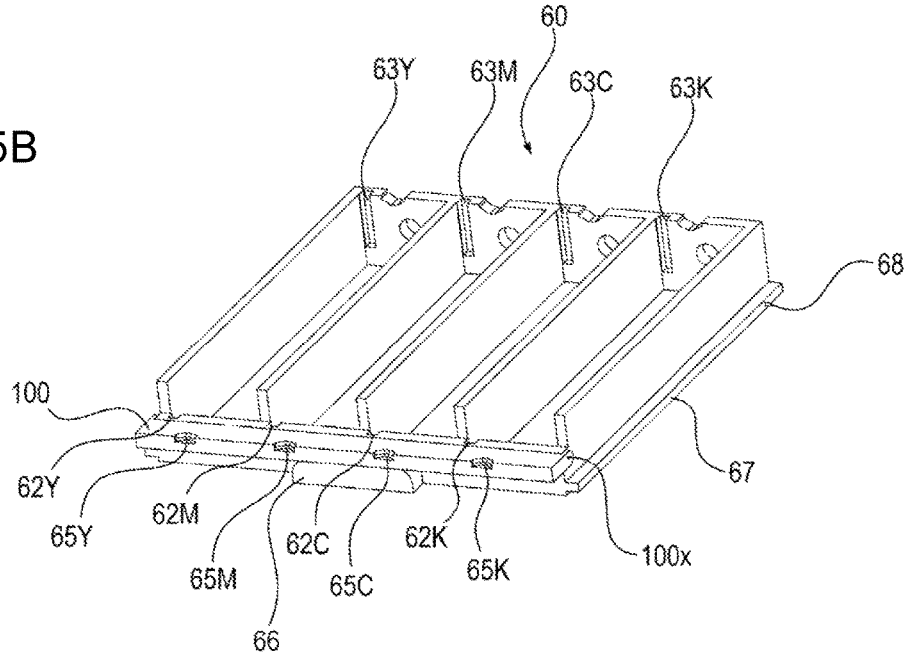

First, the process cartridge chambers 61 of the process cartridge drawer 60 (which hereafter will be referred to simply as drawer 60) in this embodiment are described about their structure. FIG. 15 is a perspective view of the drawer 60. FIG. 15A shows the state of the drawer 60 when a door 100 (which will be described later) is closed, whereas FIG. 15B shows the state of the drawer 60 when the door 100 is open.

Referring to FIG. 15, the drawer 60 is provided with four process cartridge chambers 61 (61Y, 61M, 61C and 61K), and four unshown openings for allowing a beam L of laser light to be projected upon the peripheral surface of the photosensitive drum 1. It is also provided with four openings 69 (69Y, 69M, 69C and 69K) for allowing the development roller coupling members 16 to be entered into the process cartridge chambers 61 (which hereafter will be referred to simply as cartridge chambers 61) by the closing movement of the door 100, and a handgrip 66.

Further, the upstream end of each cartridge chamber 61 of the drawer 60, in terms of the direction in which the drawer 60 is partially pulled out of the main assembly of the image forming apparatus A, is provided with a guiding portion 63 (63Y, 63M, 63C or 63K) for guiding the corresponding process cartridges P into its preset position. The guiding portion 63 vertically extends. Further, the upstream end of each cartridge chamber 61 is provided with a V-shaped positioning portion 64 (64Y, 64M, 63C or 63K) for positioning the process cartridge P relative to the drawer 60.

Further, each of the lateral walls (left and right walls) of the drawer 60, as seen from the downstream side in terms of the direction in which the drawer 60 is pulled to be partially moved out of the main assembly of the image forming apparatus A, is provided with a guiding portion 67 (rib) which is guided by the corresponding guiding member of the main assembly of the image forming apparatus A when the drawer 60 is pushed back into the main assembly. Further, the outward surface of the guiding portion 67 (rib) is provided with an engagement pin 68.

Further, the drawer 60 is provided with the door 100 (supporting portion) for supporting the downstream end of each process cartridge P, in terms of the direction in which the drawer 60 is moved when the drawer 60 needs to be moved from its innermost position to the outermost position. The door 100 is pivotally supported so that it can be pivotally moved about its pivot 100*x* to be put in the state in which it supports the downstream end of the process cartridge P, or the state in which it remains roughly horizontal and does not support the process cartridge P of FIG. 15B. In this embodiment, the drawer 60 is structured so that when the door 100 is in its disengagement position, that is, when it does not supports the process cartridge P, it remains roughly parallel to the moving direction of the drawer 60.

Further, the door 100 is provided with positioning portions 65 (65Y, 65M, 65C and 65K), as positioning means, for positioning the process cartridges P relative to the drawer 60, and guiding portions 62 (62Y, 62M, 62C and 62K). Further, each positioning portion 65 has a guiding surface 65*x* (FIG. 16).

Next, the process for inserting the process cartridges P into the drawer 60 is described. Referring to FIG. 6, it is when the door 100 is in its nonengagement state that the process cartridges P are inserted into the cartridge chamber 61 one for one.

Figure 16:
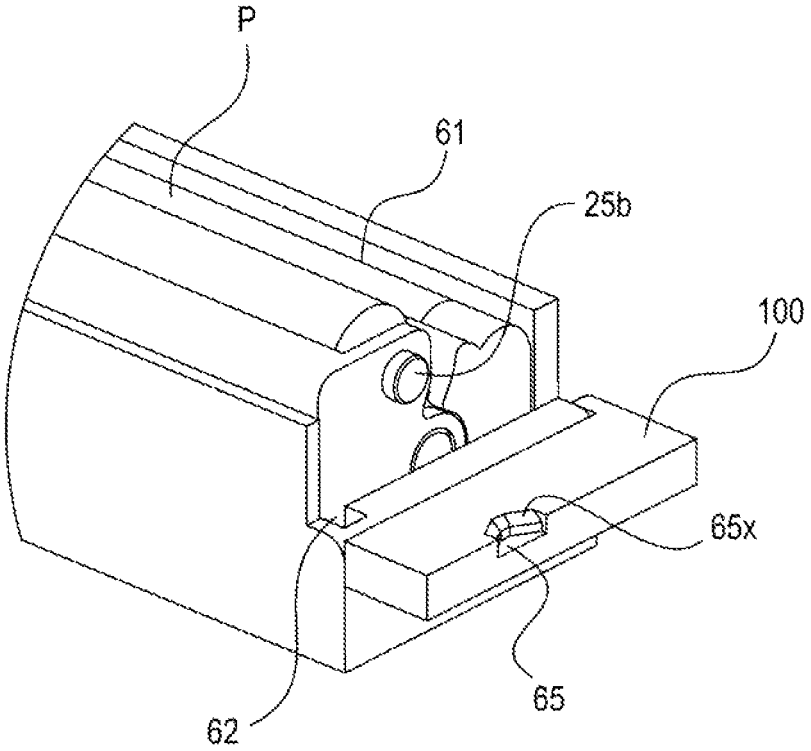
FIG. 16 is a perspective view of the outward end portion of one of the process cartridge chambers of the drawer when the front door is open, and is for describing how the process cartridge is inserted into the chamber.
Figure 17A:
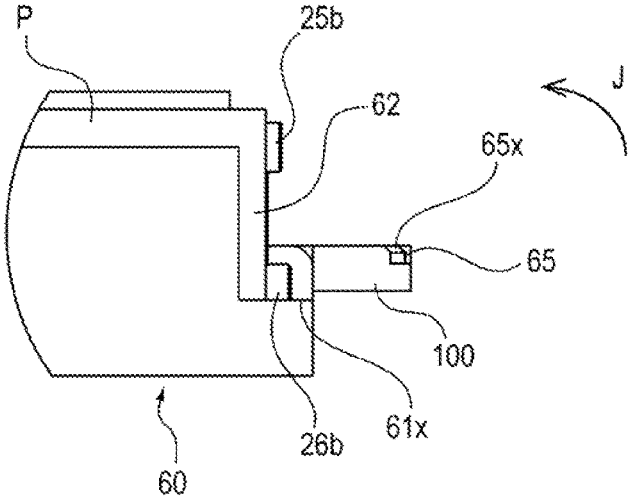
FIGS. 17A, 17B, and 17C are side views of the outward end portion of one of the process cartridge chambers of the drawer, and are for describing how the process cartridge is inserted into the chamber.

FIG. 17A is a sectional view of the cartridge chamber 61 when the cartridge chamber 61 is in the state shown in FIG. 16. As described above, it is when the door 100 is in the nonengagement state that the process cartridges P are inserted into the cartridge chambers 61 one for one. When each process cartridge P is inserted into the corresponding cartridge chamber 61, the rotation controlling portion 26*b* of the process cartridge P fits into the guiding portion 62 of the drawer 60. Further, the rotation controlling portion 26*b* bears the load from the process cartridge P by remaining in contact with the contact surface 61*x* of the cartridge chamber 61.

Figure 17B:
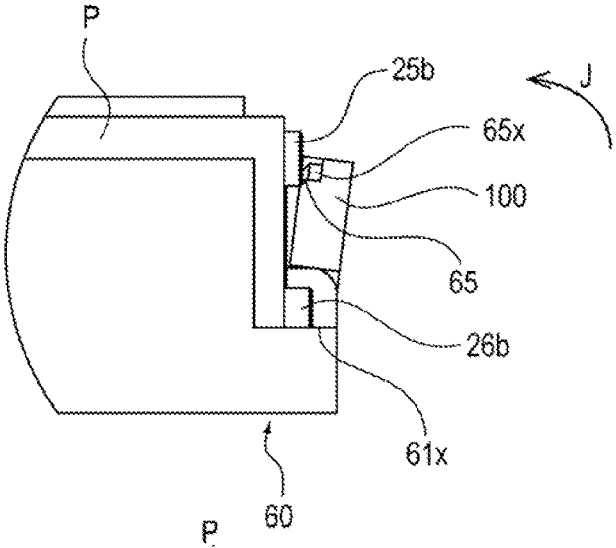
Figure 17C:
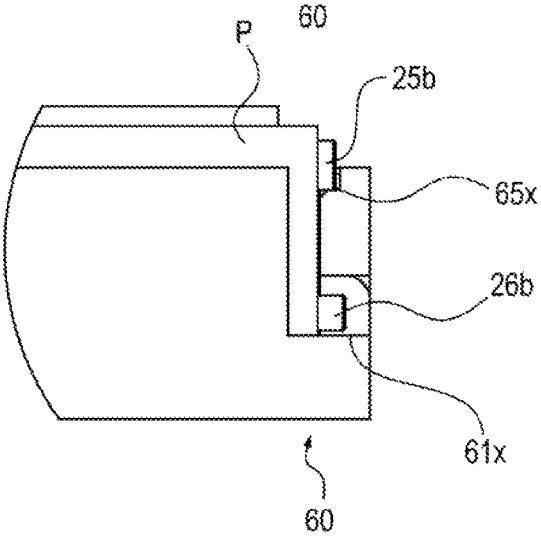

Next, referring to FIG. 17B, as the door 100 is rotationally moved in the direction indicated by an arrow mark J, the guiding surface 65*x* of the positioning portion 65 comes into contact with the tip of the positioning portion 25*b* of the process cartridge P. Then, as the door 100 is further rotated, force is applied to the positioning portion 25*b* from the guiding surface 65*x*, whereby the process cartridge P is lifted.

Then, as the door 100 is put in the state in which it holds the process cartridge P, the positioning portion 25*b* of the process cartridge P, which is being held by the guiding surface 65*x*, comes into contact with the positioning portion 65. Thus, the process cartridge P is positioned relative to the drawer 60. During this process, the rotation controlling portion 26*b* of the process cartridge P is not in contact with the contact surface 61*x* of the cartridge chamber 61. Thus, it controls the process cartridge P in attitude only in the rotational direction of the photosensitive drum 1 and the like in the process cartridge P.

Next, the movement of the drawer 60 is described. The drawer 60 is movable between its innermost position in the image forming apparatus A, that is, the position in which it keeps the process cartridges P in the image forming positions, and its outermost position relative to the main assembly of the image forming apparatus A.

Figure 18:
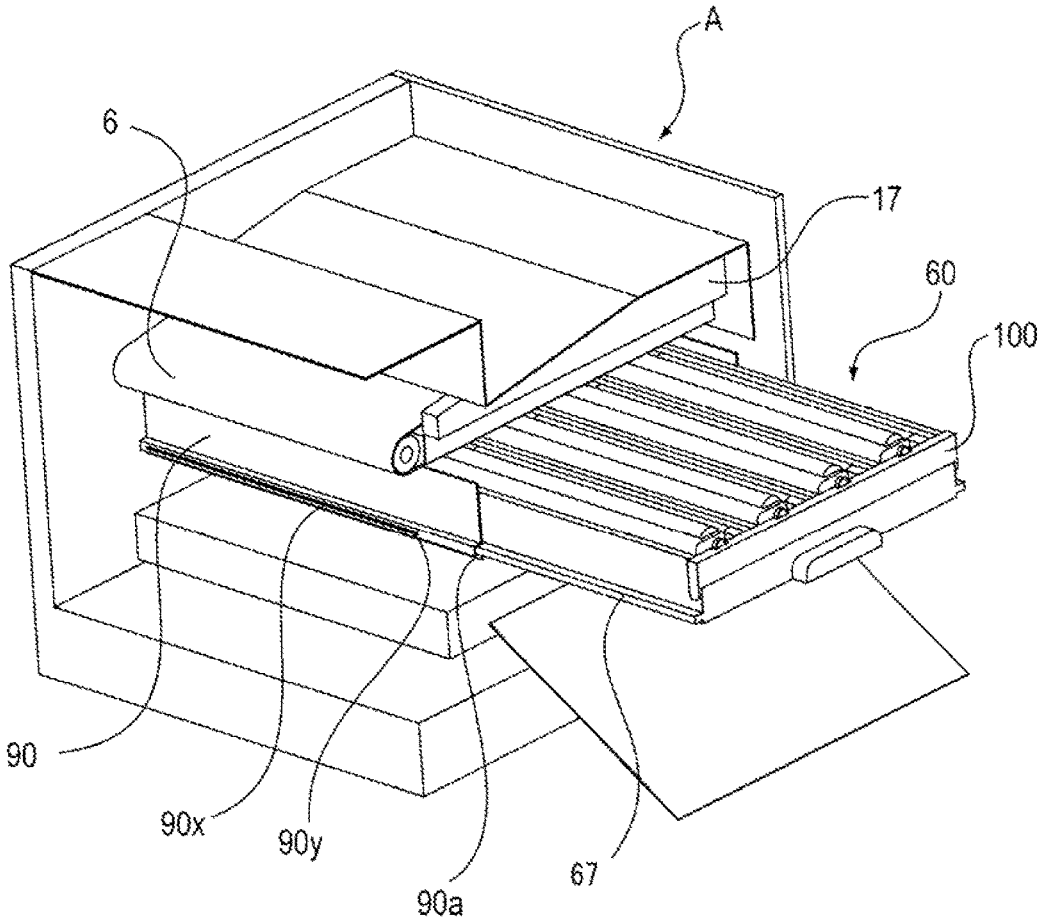
FIG. 18 is a partially broken perspective view of the image forming apparatus, and is for showing the relationship between the drawer and guiding members of the apparatus.

Referring to FIG. 18, the image forming apparatus A is structured so that the drawer 60 is movable in the direction indicated by the arrow mark X, which is parallel to the axial line of the photosensitive drum 1, while being guided by the guiding members 90 of the image forming apparatus A. More concretely, the guiding portions 67 of the drawer 60 fit in the engaging portions 90*a* (grooves) of the guiding members 90, whereby the drawer 60 is regulated in the direction in which it moves. Further, the engagement pin 68 of the drawer 60 is put through the guiding groove 90*x*, with which the guiding member 90 is provided.

Further, as the drawer 60 is moved further outward from the position in which it is in FIG. 18, the engagement pin 68 comes into contact with the pin contacting portion 90*y* of the guiding member 90, whereby the drawer 60 is kept in its outermost position.

By the way, when the drawer 60 is in its outermost position, the upstream end of each process cartridge P in the drawer 60, in terms of the direction in which the drawer 60 is moved when it needs to be moved from its innermost position to its outmost position, is in the image forming apparatus A. This statement that the upstream end portion of the process cartridge P is in the image forming apparatus A means that the upward projection of the process cartridge P overlaps with the inner cover 17 for covering various portions of the main assembly of the image forming apparatus A, etc.

By the way, what occurs on the other side of the drawer 60 is the same as the above-described ones. Further, the movement of the drawer 50, which occurs when the drawer 50 is moved from its outermost position to its innermost position, is the reverse of the above-described one.

Figure 19:
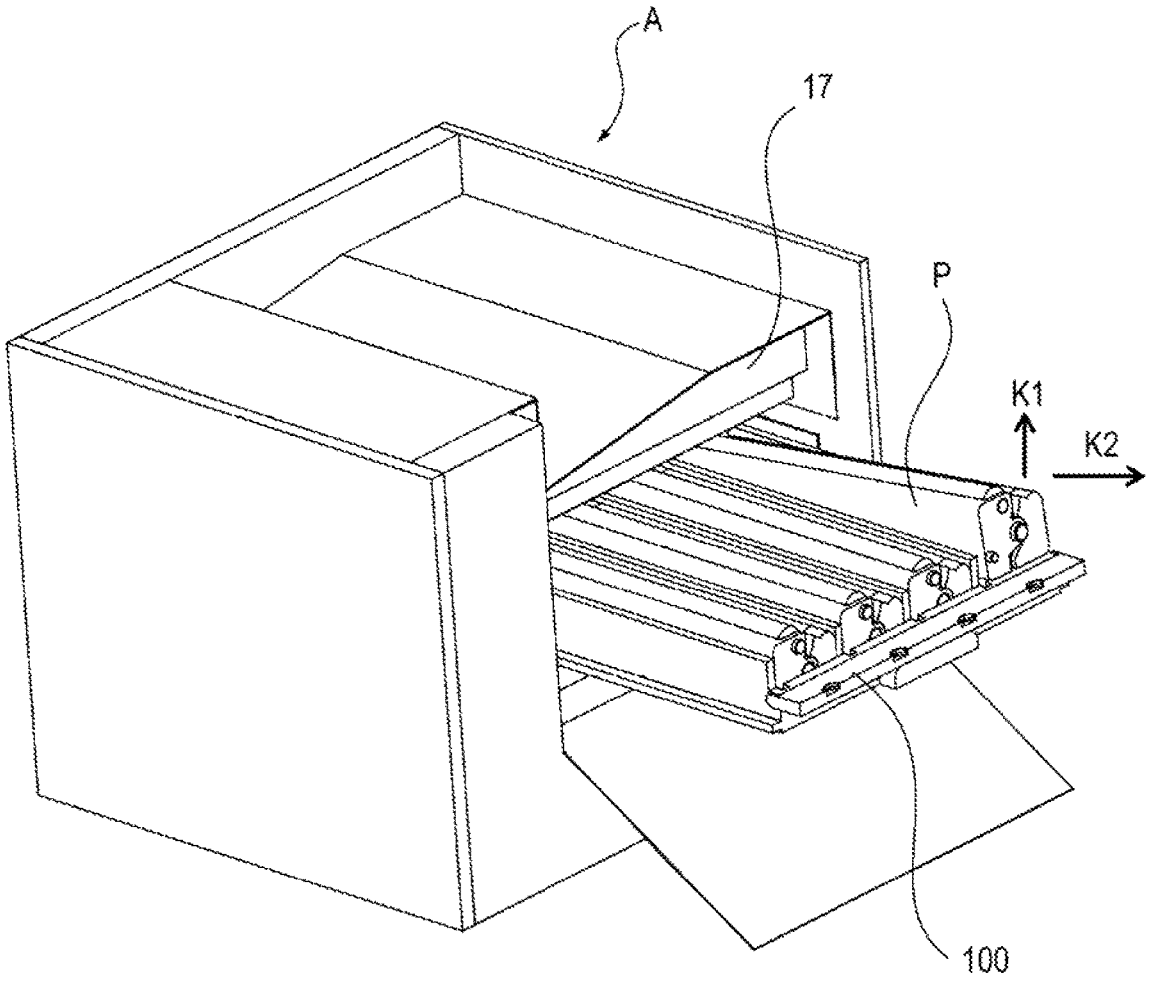
FIG. 19 is a perspective view of the image forming apparatus, and is for showing how the process cartridges are removed from the drawer.

FIG. 19 shows the state of image forming apparatus A when one of the process cartridges P is inserted into, or removed from, the drawer 60. As described above, in order to insert the drawer 60 into the drawer 60, or remove it from the drawer 60, the door 100 has to be kept in the nonengagement state. As the door 100 is put in the nonengagement state in order to insert the process cartridge P into the drawer 60, or remove the process cartridge P from the drawer 60, the surface of the door 100, by which the outward end of the process cartridge P is held, is positioned lower than when the door 100 is in the cartridge engaging state. Therefore, even if the upstream end portion of the process cartridge P is in the image forming apparatus A, it can be inserted into, or removed from, the drawer 60 in the direction indicated by an arrow mark K2 as long as the downstream end portion of the process cartridge P is slightly raised straight upward (indicated by arrow mark K1). In particular, when the door 100 is in the nonengagement state, it is parallel to the moving direction of the drawer 60. Therefore, the surface of the door 100, by which the outward end of the process cartridge P is supported is positioned even lower, making it easier for the process cartridge P to be inserted into, or removed from, the drawer 60.

Therefore, the process cartridge P can be inserted into, or removed from the drawer 60, without being made to collide with the other portions of the main assembly of the image forming apparatus A, even through the drawer 60 does not need to be pulled out as much as it has to be in the case of a conventionally structured image forming apparatus. Therefore, the image forming apparatus in this embodiment is substantially smaller in the amount by which the center of gravity of the main assembly of the image forming apparatus A shifts, remaining therefore more stable in attitude than the conventional image forming apparatus, when the process cartridge P in the drawer 60 is replaced.

Embodiment 3

Next, the image forming apparatus A in the third embodiment of the present invention is described with reference to drawings. The portions of the image forming apparatus A in this embodiment, which are the same in description as the counterparts in the above-described first and second embodiments, are given the same drawings and referential codes as those for the counterparts, and are not described here.

Figure 20:
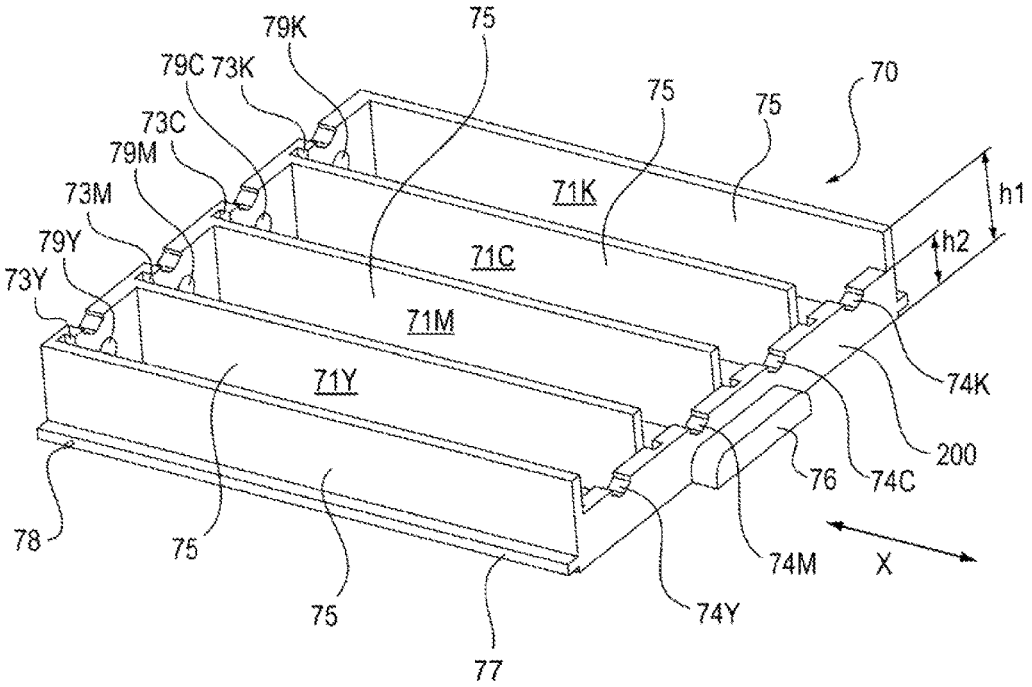
FIG. 20 is a perspective view of the drawer.

First, the drawer 70 in this embodiment is described about its structure. FIG. 20 is a perspective view of the drawer 70.

Referring to FIG. 20, the drawer 70 is provided with four process cartridge chambers 71 (71Y, 71M, 71C and 71K), and four unshown openings for allowing a beam L of laser light to be projected upon the peripheral surface of the photosensitive drum 1.

The drawer 70 is also provided with four openings 79 (79Y, 79M, 79C and 79K) for allowing the development roller coupling members 16 to be entered into the process cartridge chambers 71 (which hereafter will be referred to simply as cartridge chambers 71) by the closing movement of the door 100. Further, it is provided with a handgrip 76.

Further, the downstream end of the drawer 70, in terms of the direction in which the drawer 70 moves when the drawer 70 is moved from its innermost position to its outermost position, is provided with a front wall 200 (holding portion) which holds the downstream portion of each process cartridge P. Further, the drawer 70 is provided with five walls 75 (holding portions) which laterally support the process cartridges P. The height h2 of the front wall 200 is less than the height h1 of each of the five walls 75.

Further, the front wall 200, and the opposite wall from the front wall 200, are provided with a guiding portion 73 (73Y, 73M, 73C and 73K), which is for guiding the process cartridge P to a preset position in the cartridge chamber 71, and which vertically extend. Further, each of the front wall 200 and the opposite wall is provided with a V-shaped positioning portion 74 (74Y, 74M, 74C and 74K) as a positioning means for placing the process cartridge P in a preset position in the drawer 70.

Further, each of the lateral walls of the drawer 70, as seen from the moving direction of the drawer 70, is provided with guiding portion 77, which is guided by the guiding member of the main assembly of the image forming apparatus A. Further, the side surface of the guiding portion 77 is provided with a engagement pin 78.

Figure 21:
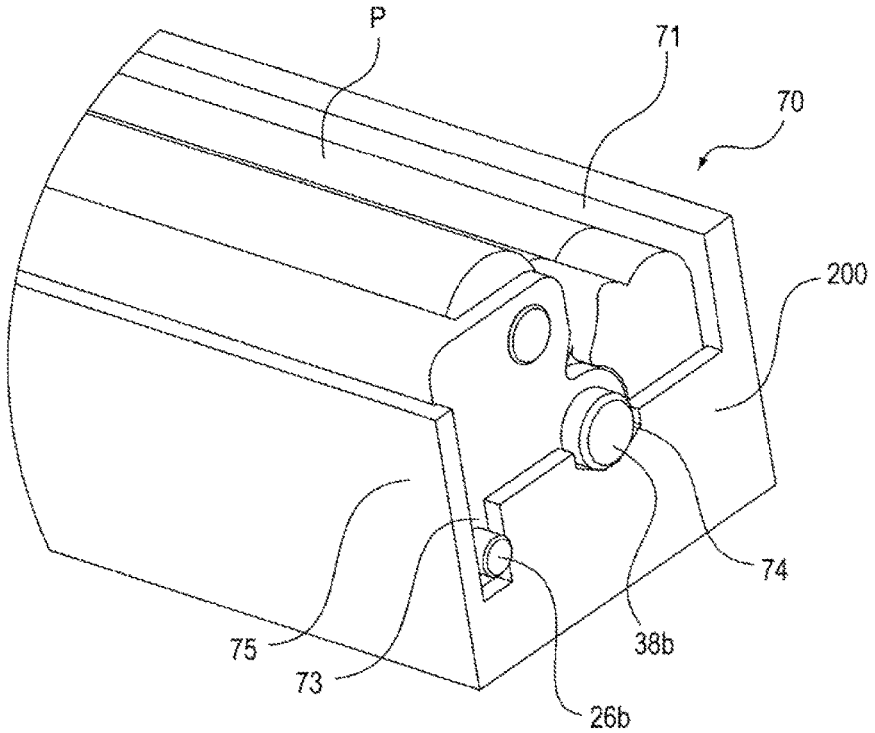
FIG. 21 is a perspective view of the outward end of one of the process cartridge chambers of the drawer, and is for showing how the process cartridge is inserted into the drawer.

Next, the process of mounting each process cartridge P into the drawer 70 is described. FIG. 21 is a perspective view of the downstream end portion of a combination of one of the cartridge chamber 71 and the process cartridge P therein, in terms of the direction of the outward movement of the drawer 70.

Referring to FIG. 21, as the process cartridge P is inserted into the cartridge chamber 71, the engaging portion 38*b* of the process cartridge P comes into contact with the positioning portion 74 of the drawer 70. The positioning portion 74 is in the form of a letter V. Therefore, as the engaging portion 38*b* comes into contact with the positioning portion 74, the process cartridge P is properly positioned relative to the drawer 70. Further, the rotation regulating portion 26*b* comes into contact with the lateral surface of the guiding portion 73, controlling thereby the photosensitive drum 1 and the like in the process cartridge P in attitude in terms of their rotational direction.

Next, the movement of the drawer 70 is described. The drawer 70 is movable between its innermost position in the image forming apparatus A, that is, the position in which it keeps the process cartridges P in the image forming positions, and its outermost position, in which it is almost entirely exposed from the image forming apparatus A.

The image forming apparatus A is structured so that the drawer 70 can be moved outward of the image forming apparatus A by being guided by the unshown guiding members, with which the image forming apparatus A is provided. While the drawer 70 is moved outward of the image forming apparatus A, the guiding portions 77 of the drawer 70 remain engaged in the engaging portions (grooves) of the guiding portions. Thus, the drawer 70 is regulated in the moving direction. Further, the engagement pin 78 is in the guiding groove which the guiding member has. Thus, as the drawer 70 is moved further outward, the engagement pin 78 comes into contact with the pin contacting portion of the guiding member, locking the drawer 70 in its outermost position.

By the way, when the drawer 70 is in its outermost position, the upstream end of each process cartridge P in the drawer 70, in terms of the direction in which the drawer 70 is moved when it is moved from its innermost position to its outmost position, is in the image forming apparatus A. This statement that the upstream end portion of the process cartridge P is in the image forming apparatus A means that the upward projection of the process cartridge P overlaps with the inner cover 17 for covering various portions of the main assembly of the image forming apparatus A, etc.

By the way, the movement of the drawer 50, which occurs when the drawer 50 is moved from its outermost position to its innermost position, is the reverse of the above-described one.

Figure 22:
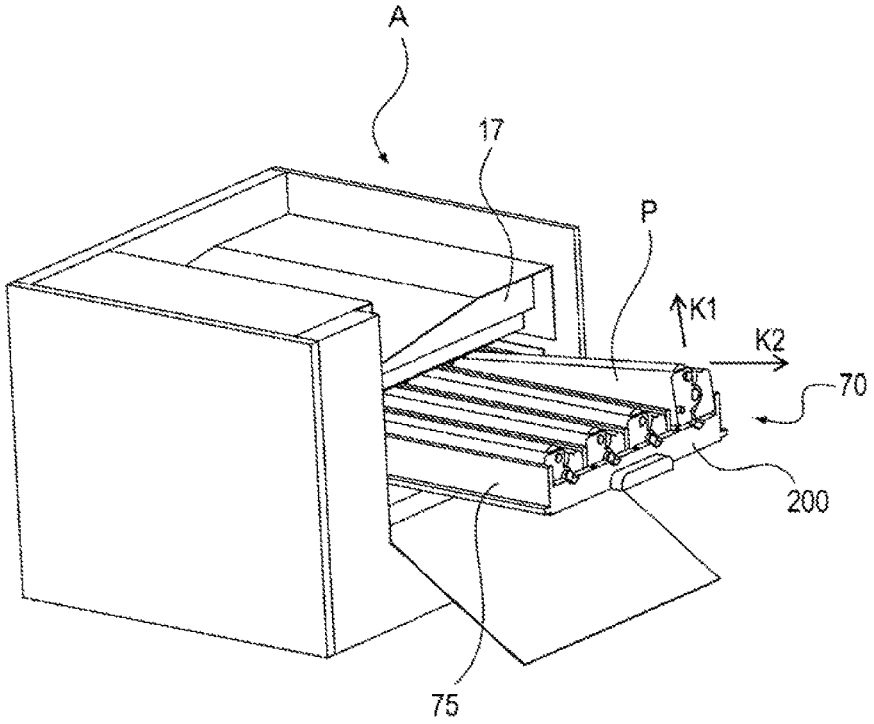
FIG. 22 is a perspective view of the image forming apparatus, and is for showing how the process cartridges are removed from the drawer.

FIG. 22 shows the state of the image forming apparatus A when one of the process cartridges P is inserted into, or removed from, the drawer 70. As described above, the front wall 200 of the drawer 70 is lower than the lateral walls 75. Therefore, even if the upstream end portion of the process cartridge P is in the image forming apparatus A, it can be inserted into, or removed from, the drawer 70 in the direction indicated by an arrow mark K2 as long as the downstream end portion of the process cartridge P is slightly raised straight upward (indicated by arrow mark K1).

Therefore, the process cartridge P can be inserted into, or removed from, the drawer 60, without being made to collide with the other portions of the main assembly of the image forming apparatus A, even though the drawer 60 does not need to be pulled out as much as it has to be in the case of a conventionally structured image forming apparatus. Therefore, the image forming apparatus in this embodiment is substantially smaller in the amount by which the center of gravity of the main assembly of the image forming apparatus A shifts, remaining therefore more stable in attitude than the conventional image forming apparatus, when the process cartridge P in the drawer 70 is replaced.

By the way, in the above-described first to third embodiments, the process cartridge P was made up of the photosensitive member unit 20 and development unit 30. However, these embodiments are not intended to limit the present invention in scope. That is, the present invention is also applicable to an image forming apparatus structured so that a photosensitive member cartridge having the photosensitive drum 1 can be removably inserted, or a development cartridge having at least a development roller and a developer storing portion can be removably inserted into the drawer 50. The results of such application are the same as those described above.

Further, in the above-described first to third embodiments, the image forming apparatuses had an intermediary transfer unit. However, these embodiments are not intended to limit the present invention in scope. That is, the present invention is also applicable to an image forming apparatus of the so-called direct transfer type, which transfers a developer image formed on the photosensitive drum 1, directly onto a sheet of image formation medium. The results of such application are the same as those described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-045693 filed on Mar. 9, 2016, which is hereby incorporated by reference herein in its entirety.

What is claimed is:

1. An image forming apparatus comprising:

a cartridge including at least one of a rotatable photosensitive member and a rotatable developer carrying member for carrying the developer to be supplied to said photosensitive member; and a supporting member configured to detachably support said cartridge, said supporting member being movable between an inside position for permitting mounting of said cartridge to said image forming apparatus and an outermost position outside said image forming apparatus in a direction along an axial direction of said photosensitive member or said developer carrying member, wherein said cartridge is mountable to and dismountable from said supporting member, at a position above said supporting member, and wherein when said supporting member is in the outermost position in a state that said cartridge is mounted to said supporting member, an upstream end portion of said supporting member with respect to a moving direction from the inside position toward the outermost position is inside said image forming apparatus, and wherein when said supporting member is in the outermost position, said supporting member is inclined so that a downstream portion of said supporting member with respect to the moving direction is at a position lower than that when said supporting member is in the inside position.

2. The apparatus according to claim 1, wherein said supporting member is slidable from the inside position to a position where said supporting member is slanted by rotation about an upstream portion with respect to the moving direction.

3. The apparatus according to claim 2, further comprising a transfer belt contacting said photosensitive member, wherein said transfer belt is disposed above the cartridge mounted to said image forming apparatus.

4. An image forming apparatus comprising:

a cartridge including at least one of a rotatable photosensitive member and a rotatable developer carrying member for carrying the developer to be supplied to said photosensitive member;

a supporting member configured to detachably support said cartridge, said supporting member being movable between an inside position for permitting mounting of said cartridge to said image forming apparatus and an outermost position outside said image forming apparatus in a direction along an axial direction of said photosensitive member or said developer carrying member; and a holding portion provided on said supporting member and configured to hold a downstream end portion of said cartridge with respect to a moving direction from the inside position toward the outermost position, wherein in the outermost position of said supporting member along the axial direction of said photosensitive member or said developer carrying member, an upstream end portion of said cartridge supported by said supporting member with respect to the moving direction is inside said image forming apparatus, and wherein said holding portion is movable between a holding position for holding said cartridge and a releasing position in which the holding is released and said holding portion is at a lower level than that in the holding position.

5. The apparatus according to claim 4, wherein said holding portion is rotatably supported, and is rotatable between the holding position and the releasing position.

6. The apparatus according to claim 5, wherein said holding portion is substantially parallel with the moving direction of said supporting member when said holding portion is in the releasing position.

7. The apparatus according to claim 6, wherein said holding portion is provided with a positioning portion for positioning said cartridge.

8. An image forming apparatus comprising:

a cartridge including at least one of a rotatable photosensitive member and a rotatable developer carrying member for carrying the developer to be supplied to said photosensitive member;

a supporting member configured to detachably support said cartridge, said supporting member being movable between an inside position for permitting mounting of said cartridge to said image forming apparatus and an outermost position outside said image forming apparatus in a direction along an axial direction of said photosensitive member or said developer carrying member; and a holding portion provided on said supporting member and configured to hold said cartridge, wherein in the outermost position of said supporting member along the axial direction of said photosensitive member or said developer carrying member, an upstream end portion of said cartridge supported by said supporting member with respect to a moving direction from the inside position toward the outermost position is inside said image forming apparatus, wherein said supporting member includes a front wall disposed downstream of said cartridge in the moving direction from the inside position toward the outermost position and a lateral wall elongated along the axial direction of said photosensitive member or said developer carrying member, and wherein said front wall is lower than said lateral wall.

9. The apparatus according to claim 8, wherein said holding portion is provided with positioning portion for positioning said cartridge.

* * * * *